US011060824B2

(12) United States Patent
Peters

(10) Patent No.: US 11,060,824 B2
(45) **Date of Patent: *Jul. 13, 2021**

(54) ANTI-BALLISTIC SHELTERS

(71) Applicant: SHIELDPRO, LLC, Irvine, CA (US)

(72) Inventor: Fred E. Peters, Irvine, CA (US)

(73) Assignee: SHIELDPRO, LLC, Irvine, CA (US)

( * ) Notice: Subject to any disclaimer, the term of this patent is extended or adjusted under 35 U.S.C. 154(b) by 700 days.

This patent is subject to a terminal disclaimer.

(21) Appl. No.: 15/489,499

(22) Filed: Apr. 17, 2017

(65) Prior Publication Data

US 2017/0219316 A1 Aug. 3, 2017

Related U.S. Application Data

(60) Division of application No. 14/686,621, filed on Apr. 14, 2015, now Pat. No. 9,625,238, which is a (Continued)

(51) Int. Cl.
*F41H 5/24* (2006.01)
*F41H 5/04* (2006.01)

(Continued)

(52) U.S. Cl.
CPC ..... *F41H 5/24* (2013.01); *A45B 25/02* (2013.01); *A45B 25/20* (2013.01); *B63B 17/02* (2013.01); *E04H 9/00* (2013.01); *E04H 9/10* (2013.01); *F41H 1/00* (2013.01); *F41H 3/02* (2013.01); *F41H 5/013* (2013.01); *F41H 5/0471* (2013.01);

(Continued)

(58) Field of Classification Search
CPC ..... F41H 3/02; F41H 5/013; F41H 5/0471; F41H 5/0485; F41H 5/0492; F41H 5/24; E04H 9/00
See application file for complete search history.

(56) References Cited

U.S. PATENT DOCUMENTS 3,712,363 A 1/1973 Thomassen et al.
4,325,309 A 4/1982 King et al.

(Continued)

FOREIGN PATENT DOCUMENTS

CA 2095815 C 5/1992
CA 2641317 A1 11/2007

(Continued)

OTHER PUBLICATIONS

International Search Report and Written Opinion dated Oct. 17, 2014 for for PCT/US1432917 (10 pages).

(Continued)

*Primary Examiner* — Bret Hayes
(74) *Attorney, Agent, or Firm* — Procopio, Cory, Hargreaves & Savitch LLP

(57) ABSTRACT

Embodiments of the present application includes methods and structures for Anti-Ballistic Shelters, including an anti-ballistic shelter having a frame comprising at least one support member, and one or more surfaces comprising a flexible high strength layered anti-ballistic material attached to the frame, wherein the flexible high strength layered anti-ballistic material is layered in at least two directions; and further wherein the layered anti-ballistic material is enveloped around the frame.

4 Claims, 16 Drawing Sheets

Related U.S. Application Data continuation of application No. 14/139,711, filed on Dec. 23, 2013, now Pat. No. 9,010,230, which is a continuation-in-part of application No. 13/659,507, filed on Oct. 24, 2012, now Pat. No. 8,613,242.

(60) Provisional application No. 61/550,596, filed on Oct. 24, 2011.

(51) Int. Cl.

| | |
|---|---|
| ***F41H 5/013*** | (2006.01) |
| ***E04H 9/10*** | (2006.01) |
| ***F41H 7/04*** | (2006.01) |
| ***A45B 25/20*** | (2006.01) |
| ***A45B 25/02*** | (2006.01) |
| ***B63B 17/02*** | (2006.01) |
| ***F41H 5/26*** | (2006.01) |
| ***F41H 1/00*** | (2006.01) |
| ***E04H 9/00*** | (2006.01) |
| ***F41H 3/02*** | (2006.01) |

(52) U.S. Cl.

CPC ..... *F41H 5/0485* (2013.01); *F41H 5/0492* (2013.01); *F41H 5/263* (2013.01); *F41H 7/048* (2013.01); *A45B 2200/1081* (2013.01)

(56) References Cited

U.S. PATENT DOCUMENTS

| | | | | |
|---|---|---|---|---|
| 4,358,984 | A | 11/1982 | Winblad | |
| 4,391,178 | A | 7/1983 | Pagano | |
| 4,403,012 | A | 9/1983 | Harpell et al. | |
| 4,412,495 | A | 11/1983 | Sankar | |
| 5,512,348 | A | 4/1996 | Mazelsky | |
| 5,545,455 | A | 8/1996 | Prevorsek et al. | |
| 5,554,816 | A | 9/1996 | Skaggs et al. | |
| 5,703,316 | A | 12/1997 | Madden | |
| 5,824,940 | A | 10/1998 | Chediak et al. | |
| 6,038,820 | A | 3/2000 | Rainbolt et al. | |
| 6,565,139 | B2 | 5/2003 | Bayerle et al. | |
| 6,846,758 | B2 | 1/2005 | Bhatnagar | |
| 7,600,348 | B1 | 10/2009 | Kostka | |
| 7,610,727 | B2 | 11/2009 | Toledo | |
| 8,210,088 | B1 | 7/2012 | Keyfauver | |
| 8,573,704 | B2 | 11/2013 | Peters et al. | |
| 8,579,367 | B2 | 11/2013 | Peters et al. | |
| 8,613,242 | B2 | 12/2013 | Peters | |
| 9,010,230 | B2 | 4/2015 | Peters et al. | |
| 9,010,231 | B1 * | 4/2015 | Cohn | F41H 5/08 89/36.07 |
| 2002/0185905 | A1 | 12/2002 | Cassinelli | |
| 2003/0127122 | A1 | 7/2003 | Gower | |
| 2004/0255769 | A1 | 12/2004 | Drackett | |
| 2006/0169313 | A1 | 8/2006 | Witte | |
| 2006/0181102 | A1 | 8/2006 | Lemieux | |
| 2007/0039639 | A1 | 2/2007 | Duncan | |
| 2009/0032076 | A1 | 2/2009 | Boldsen | |
| 2011/0253184 | A1 | 10/2011 | Mills | |
| 2011/0303254 | A1 | 12/2011 | Tucker et al. | |
| 2012/0152096 | A1 | 6/2012 | Peters | |
| 2012/0247313 | A1 | 10/2012 | Peters | |
| 2012/0248837 | A1 | 10/2012 | Peters | |
| 2012/0295057 | A1 | 11/2012 | Atorrasagasti | |
| 2014/0318037 | A1 * | 10/2014 | Aldino | E04B 7/163 52/90.1 |
| 2015/0247707 | A1 * | 9/2015 | Rossow | F42D 5/05 89/36.02 |
| 2017/0219316 | A1 * | 8/2017 | Peters | F41H 5/24 |

FOREIGN PATENT DOCUMENTS

| | | | |
|---|---|---|---|
| CA | 2935017 | C | 1/2019 |
| WO | 2012164311 | A1 | 12/2012 |

OTHER PUBLICATIONS

International Search Report and Written Opinion for PCT/US12/61670 dated Jan. 8, 2013 (9 pages).

Extended European Search Report received in related European patent application No. 14874771.0, dated Oct. 18, 2016, (7 pages).

Office Action for related Canadian Patent Application No. 2868569, dated Apr. 15, 2019; 4 pages.

Office Action for related Canadian Patent Application No. 2868569, dated Jul. 13, 2018; 5 pages.

* cited by examiner

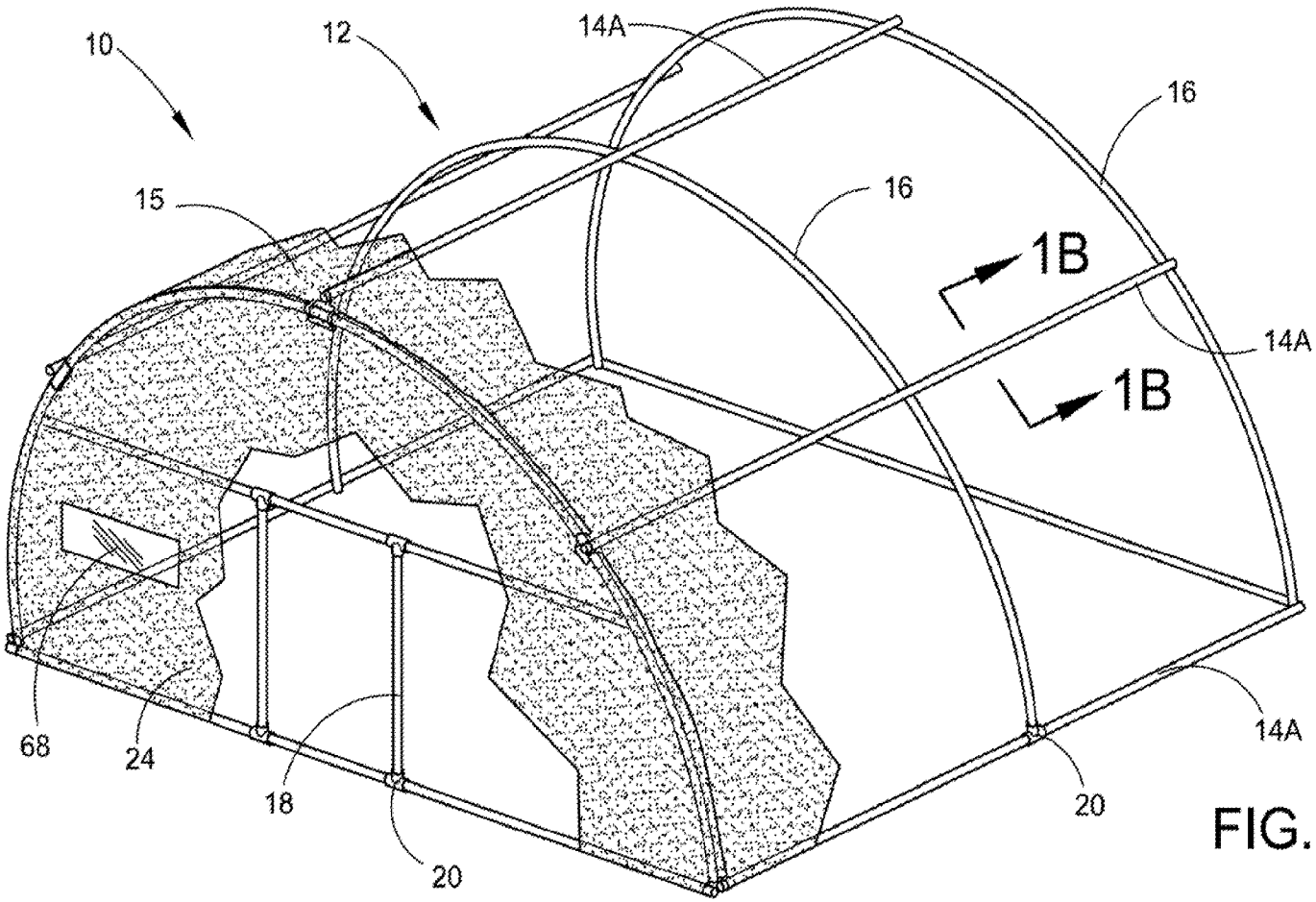
FIG. 1A
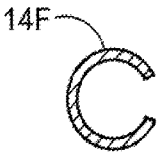
FIG. 1B
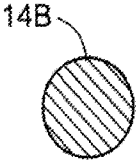
FIG. 1C
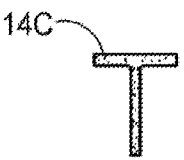
FIG. 1D
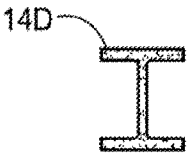
FIG. 1E
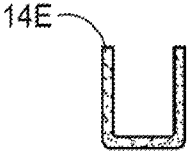
FIG. 1F
FIG. 1G

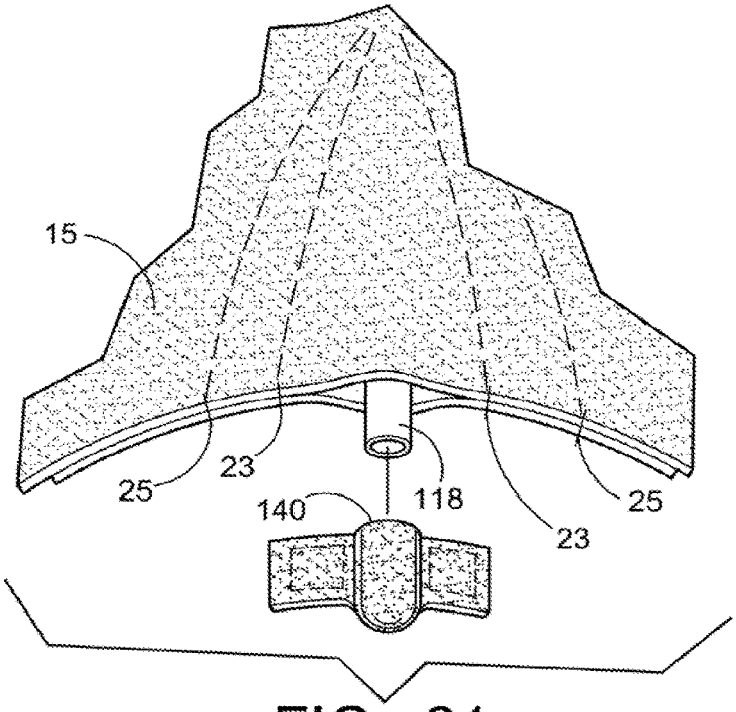
FIG. 21
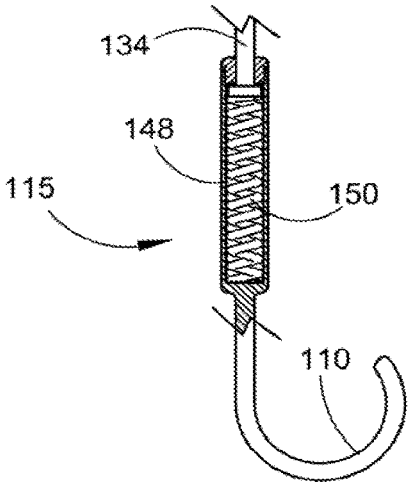
FIG. 25
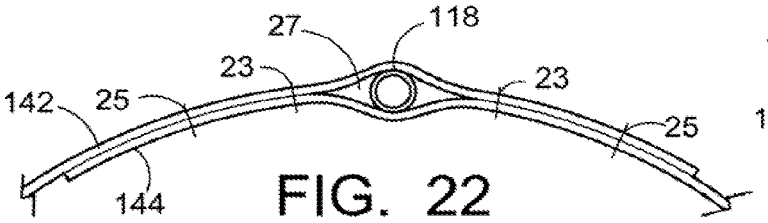
FIG. 22
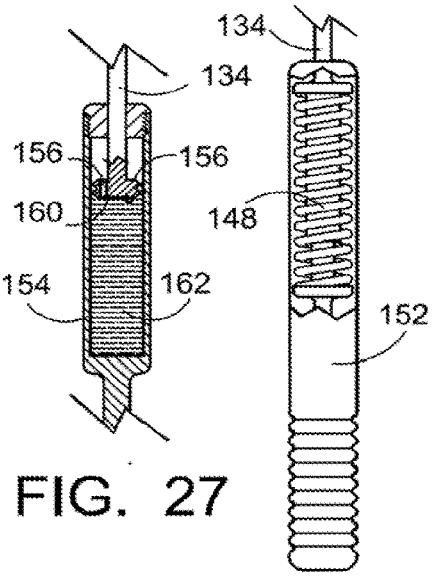
FIG. 27
FIG. 26
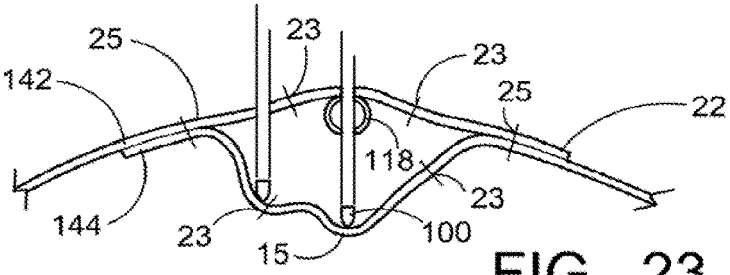
FIG. 23
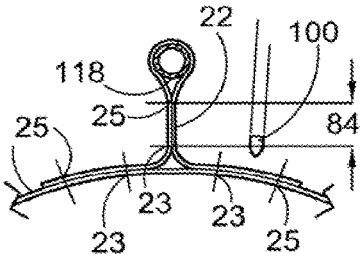
FIG. 24A
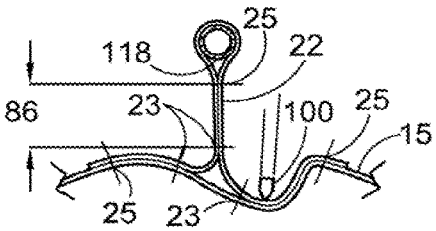
FIG. 24B
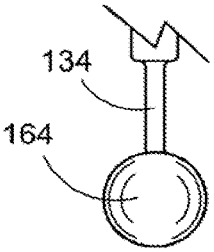
FIG. 28

ANTI-BALLISTIC SHELTERS

CROSS-REFERENCE TO RELATED APPLICATIONS

This application is a Divisional of U.S. application Ser. No. 14/686,621, filed on Apr. 14, 2015, which is a continuation of U.S. application Ser. No. 14/139,711, filed Dec. 23, 2013, which is a continuation in part of U.S. application Ser. No. 13/659,507, filed Oct. 24, 2012, which claimed priority to U.S. Provisional Application Ser. No. 61/550,596, the contents all of which are incorporated herein by reference.

FIELD OF INVENTION

This application provides a unique construction of Anti-ballistic Shelters for personal and group use which are both portable and fixed in location. More particularly, protective elements of the Anti-ballistic Shelters will consist of layers of flexible anti-ballistic fabric, known as soft armor, layered in at least two directions attached to Quonset hut buildings or other shelters, using a variety of materials such as pipe, rods and extrusions to construct frame structures, room dividers, panels, doors, cots, mattresses, pads, furniture, umbrellas and tents. The unique intent of this application is in keeping the majority of the area of the anti-ballistic fabric, used in a variety of items, in a position of maximum flexibility for maximum bullet resistant characteristics and capability.

BACKGROUND

This application describes new and unique methods using the latest design of anti-ballistic protection available in the construction of a wide variety of anti-ballistic shelters. Presently these materials are fabricated using not only Aramid fibers and KEVLAR® from DuPont, but also polyethylene fibers and GOLD SHIELD which is a KEVLAR® based material, and SPECTRA SHIELDS, which is polyethylene based material, both available commercially from Honeywell. GOLD SHIELD® and SPECTRA SHIELD® are high strength synthetic fibers impregnated in partially cured resin for use in anti-ballistic, material. Moreover, both of the Honeywell materials can be used as layered soft armor as well as in hard armor when they are autoclaved or compression molded into anti-ballistic components for construction of the Anti-ballistic Shelters, as shown and described. Other similar materials manufactured by any number of providers, of like purpose and functionality is also anticipated by this disclosure.

Bullet proofing or bullet-resistance is the process of making something capable of stopping a bullet or similar high velocity projectiles, e.g. shrapnel by the means of the flexible resistance of the fabric when struck by an object. The term bullet resistance is often preferred because few, if any, practical materials provide complete protection against all types of bullets, or multiple hits in the same location. Bullet designs vary widely, not only according to the particular firearm used (e.g. a 9×19 mm Parabellum caliber hollow point handgun cartridge will have inferior penetration power compared to a 7.62×39 mm assault rifle cartridge), but also within individual cartridge designs. As a result, whilst so-called "bullet-proof" panels may successfully prevent penetration by standard 7.62×39 mm bullets containing lead cores, the same panels may easily be defeated by 7.62×39 mm armor piercing bullets containing hardened steel penetrators.

Bullet-resistant materials, also called ballistic materials or, equivalently, anti-ballistic materials, are usually rigid, but may be supple. They may be complex, such as KEVLAR®, LEXAN®, and carbon fiber composite materials, or they may be basic and simple, such as steel or titanium. Bullet resistant materials are often used in law enforcement and military applications, to protect personnel from death or serious injuries, With the advent of new materials and the improvement of manufacturing processes, items like ballistic-proof or bullet resistant structures can become practical. It is well known that the construction of bullet-proof vests is done by applying multiple layers of fabric woven from an aramid fiber together, which is sold by Du Pont under the Trade Mark KEVLAR®, and has been done for many years, it can be used in a flexible state or laminated in a more rigid configuration. The success of the product is attained by multiple layers of the semi-impregnable flexible structure. This material combines high penetration resistance with lightness and flexibility but until presently no one has endeavored to manufacture items like Anti-ballistic Shelters of this material.

There is a growing need for methods of self-protection in an increasingly wide variety of locations. In the modern world, crimes and attacks committed by persons with guns are an ever more common occurrence. In the past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing, a high velocity bullet or shell from penetrating the wearer's body since the velocity is slowed considerably.

It has been made clearly evident by the shooting at Fort Hood that additional means of self-protection has become very necessary. The mass shooting, took place on Nov. 5, 2009, at Fort Hood, the most populous U.S. military installation in the world, located just outside Killeen, Tex. In the course of the shooting, a single gunman killed 13 people and wounded 29 others. According to witnesses, Army reserve Captain John Gaffaney attempted to stop Hasan, either by charging him or throwing a chair at him, but was mortally wounded in the process. Civilian physician assistant Michael Cahill also tried to charge Hasan with a chair before being shot and killed. Army reserve Specialist Logan Burnette tried to stop Hasan by throwing a folding table at him, but he was shot in the left hip, fell down, and crawled to a nearby cubicle.

Consequently, there exist a need for a methods which will give anti-ballistic protection to a wide variety of structures. It has been found through the endeavors of the inventor and the patent search that there is no method on the market and no apparent patents reviewed that have, similar characteristics to the unique method of creating Anti-ballistic Shelters.

Numerous innovations for the Anti-ballistic Shelter have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Anti-ballistic Shelter and the prior art.

U.S. Pat. No. 5,392,686 of Wilfred A. Sankar describes a protective shield, comprising a frame. The frame having a frame top, a frame bottom, frame sides, and frame upper sides between the frame sides and frame top. The shield further having a front panel and a back panel, each made from a bullet-proof plastic fabric such as KEVLAR®. The shield has a viewing window, made of a transparent bullet-proof material, such as LEXAN®. A shield inner channel is mounted between the front panel and back panel. A first extension is mounted within the shield inner channel that slidably extends from the shield bottom for use, and retracts for storage.

This patent describes a protective shield and it's construction only and does not endeavor to make any reference to using the design in the construction of a wide range of Anti-ballistic Shelters, doors, cots, pads, umbrellas and tents and does not describe the unique method of attaching the anti-ballistic materials to various pipe frame structures.

U.S. Pat. No. 4,412,495 of Wilfred A. Sanker describes a Total Body Protective device including a pair of fabric panels made of bullet-proof material, handles on an upper of the panel pieces for holding the device in front of a person, and a window through the top panel piece for observing an assailant, and means to roll up or fold the device when not in use.

This patent describes a Total Body Protective device but does not deal with sheltering devices such as Quonset buildings or huts, pipe frame structures, doors, cots, pads, umbrellas and tents.

U.S. Pat. No. 8,017,048 of James H. Carter describes an emergency shelter that includes a domed foam structure that is constructed on-site or at a remote location from foam that can be mixed on-site. The structure can be made on-site by spraying foam in a flowable state in a predetermined pattern to build up walls to form a dome. The foam can be sprayed, for example, in a substantially helical pattern from a centrally located spray nozzle that is rotated to deposit a finite-thickness increment of foam over a time period sufficient that, by the time the nozzle reaches a previously sprayed area, the foam already deposited has had time to cure.

This patent describes an emergency shelter that includes a domed foam structure but does not use the flexible anti-ballistic fabric.

U.S. Pat. No. 8,001,987 of Marty Williams describes a support system for tents and other shelters. The support system includes base support members that are in the shape of an arch. These base support members are secured in a desired configuration by an upper support member that is in the shape of a circle or other geometrical shape. A roof support may be added as well. The size and configuration of the shelter may be easily changed by adding or deleting the number of base support members.

This patent describes a support system for tents and other shelters but additionally does not use the flexible anti-ballistic, fabric.

U.S. Pat. No. 7,882,849 of Matt Franta describes a flame-resistant fabric for shelters including a flame-resistant interior layer, a flame-resistant, insulating middle layer adjacent the interior layer, a flame-resistant exterior layer adjacent the insulating middle layer, and at least one threaded seam quilting the insulating middle layer between the interior layer and the exterior layer to form a flame-resistant fabric. The flame-resistant fabric is capable of being formed into a flame-resistant, insulated shelter for use in extreme weather.

This patent describes flame-resistant fabric for shelters but does address the use of flexible anti-ballistic fabric.

U.S. Pat. No. 7,856,761 of James Heselden a protective shelter that can be used to provide protection within a war zone, and which can be readily assembled in a quick, secure and reliable manner. The shelter is formed of opposite outer walls and a roof structure extending there between, wherein the roof structure comprises a plurality of tray members supported by beam supports and in which the plurality of tray members is arranged to receive earth, sand or aggregate material so as to provide a first layer of protection via the roof structure. The tray members can be supported by beams serving to define a shallow arch across the shelter such that the internal height of the shelter centrally, and away from the opposite walls, which is greater than the height of the said walls.

This patent describes a protective shelter that can be used to provide protection through the use of earth, sand and aggregate material within a war zone, but does not address the use of the flexible anti-ballistic fabric used on the Anti-ballistic Shelters disclosed within this application.

None of these previous efforts, however, provides the benefits attendant with the Anti-ballistic Shelters. The present designs achieves their intended purposes, objects and advantages over the prior art devices through a new, useful and unobvious combination of method steps and component elements, with the use of a minimum number of functioning parts, at a reasonable cost to manufacture, and by employing readily available materials.

In this respect, before explaining at least one embodiment of the methods of manufacturing Anti-ballistic Shelters in detail it is to be understood that the Anti-ballistic Shelters are not limited in its application to the details of construction and to the arrangement, of the components set forth in the following description or illustrated in the drawings. The Anti-ballistic Shelters are capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present methods of manufacturing Anti-ballistic Shelters. It is important, therefore, that the claims be regarded as including such equivalent construction insofar as they do not depart from the spirit and scope of the present application.

SUMMARY

The principal advantage of the Anti-ballistic Shelters is to provide a full range of shelter structures and various other items capable of ballistic protection.

Another advantage of Anti-ballistic Shelters is to supply a full range of numerous shelter structures and various other items capable of ballistic protection in portable modular designs.

Another advantage of Anti-ballistic Shelters is to supply a wide range of structures and various other items that can be relatively inexpensive to manufacture.

Another advantage is to supply Anti-ballistic Shelters and various other items to be fabricated of a variety of materials including multiple layers of soft fabric woven material from an aramid fiber which is sold by Du Pont under the registered trademark KEVLAR®, or other providers, and will resist and absorb the impact of a bullet and referred to in this application as soft armor.

Another advantage of the Anti-ballistic Shelters is that the unique mounting a the anti-ballistic material can be used on different items such as doors, room dividers, cots, furniture, umbrellas, tents, personnel transport truck bed covers and Bimini-type boat covers.

Another advantage of the Anti-ballistic Shelters is that camouflage and water resistant materials or coatings can easily he added to the construction materials, Another advantage of the Anti-ballistic Shelters is that they can be used in a wide range of applications from military, governmental, schools and private applications, as well as personal applications.

The foregoing has outlined some of the more pertinent advantages of the methods of manufacturing Anti-ballistic Shelters. These advantages should be construed to be merely illustrative of some of the more prominent features and applications of the intended methods of manufacturing Anti-ballistic Shelters. Many other beneficial results can be attained by applying the disclosed methods of manufacturing Anti-ballistic Shelters in a different manner or by modifying embodiments within the scope of the disclosure. Accordingly, other advantages and a fuller understanding of the methods of manufacturing Anti-ballistic Shelters may be had by referring to the summary of this application and the detailed description of the embodiments in addition to the scope of the methods of manufacturing Anti-ballistic Shelters defined by the claims taken in conjunction with the accompanying drawings, The methods of manufacturing Anti-ballistic Shelters make use of materials that are fabricated using not only Aramid fibers such as the para-aramid compound KEVLAR® from DuPont, but also polyethylene fibers and GOLD SHIELD® woven polyethylene fibers, which is combined with para-aramids such as KEVLAR®, and SPECTRA SHIELD®, which is polyethylene based woven fiber material, both available commercially from Honeywell, and other providers. GOLD SHIELD® and SPECTRA SHIELD® are high strength synthetic fibers impregnated in partially cured resin for use in anti-ballistic material. Moreover, both of the Honeywell materials can additionally be used as layered soft armor as well as in hard armor when they are autoclaved or compression molded into anti-ballistic components for construction of the Anti-ballistic Shelters. This material combines high penetration resistance with lightness of weight. Hereinafter, GOLD SHIELD® and SPECTRA SHIELD® polyethylene woven fibers and KEVLAR® para-aramid fibers will be referred to simply as GOLD SHIELD®, SPECTRA SHIELD® and KEVLAR®.

Soft armor requires an area of flexibility or expansion to work effectively when struck by a projectile. If these materials are completely restricted their effectiveness is diminished. With the unique design of this application the soft armor can be attached to a variety of frame structure and items allowing the flexibility or expansion required for maximum protection. Using these methods of manufacturing a wide range of Anti-ballistic Shelters may be constructed, including, but not limited to, Quonset hut buildings or huts and tents, in addition to cots, furniture, pads, mattresses, room dividers, doors, umbrellas, personnel transport truck bed covers and Bimini-type boat covers.

The Anti-ballistic Shelters have many very similar applications. The Quonset hut style of Anti-ballistic Shelter with horizontal steel pipe members and hoop style pipe supporting members is a prime example. A variety of extruded shapes of supporting members with varying attachment means will work equally as well in these applications. Additional door support pipe members and the ground level pipe members will be held together by the means of Speed-Rail Fittings® made by Hollaender™ Manufacturing Inc. for aluminum fittings or Kee Klamp™ pipe fittings for steel fittings, in one possible example. The upper anti-ballistic fabric surface, the front wall anti-ballistic fabric and rear wall will be covered with layers of flexible anti-ballistic fabric (soft armor) layered in two directions. Varying numbers of horizontal pipe members and hoop style pipe supporting members may vary depending upon where larger numbers are required for adequate protection from possible larger projectiles. A variety of shapes of pipe, rod, tubular and other frame structures including tents, lean-tos and canopies can be constructed in this manner and will remain within the scope of this application.

The attachment of the anti-ballistic material fabric may be accomplished by a variety of different means including compressive clamping or inserting within a "C" tubular member with a round central retainer rod or rope. A unique method of attachment of the anti-ballistic material fabric is a clamp that has been designed having upper clamp member and a lower clamp member, each having a plurality of teeth on the gripping edges. A nut and bolt will secure the two halves tightly together. With the potential forces exerted on the material by a projectile the fabric clamps must be very rugged and closely spaced.

A bidirectional pipe clamp has been designed to attach the horizontal members to the curved hoop style pipe supporting members. The bi-directional pipe clamp consists, of four common clamping segments with elongated holes where the two pairs of the clamping segments will interlock. Orifices will be used by the bolts and nuts to clamp the bi-directional pipe clamp to the horizontal pipe member and the hoop style pipe supporting members. The benefit in using these fittings is that they are made of steel not aluminum and much less subject to breakage under high impacts.

An additional means of attachment of the anti-ballistic fabric surface is by using a fabric inverted "T" construction or sleeve method with a breakaway stitch and a holding stitch over the structural members. Stitches having different tensile strengths allow the breakaway stitch to release before the holding stitch. The inverted "T" construction or sleeve method has been designed where the anti-ballistic fabric and other materials are covering the supporting pipe members with two or more rows of stitches running the length of the section. In the inverted method the vertical singular leg of the is constructed of material with calculated flexibility or stretch to accommodate the shock loading of a projectile impact. The sleeve method utilizes calculated tensile strength stitching so that a projectile impact shock load breaks away the stitches as is stretches under load. The breakaway stitches on either side of the supporting members will absorb the initial shock and most likely break away while the holding stitch will receive less shock and will resist being completely broken away. This method may use a hook loop fastening method or adhesive for the same purpose or a combination of both adhesive and stitching to accomplish the desired task.

Additional uses will be in wall tents, pup tents, bivy-type (one person tents) shelters, dome (multi-person) tents, truck personnel carriers and Bimini-type boat covers where the anti-ballistic fabric covering will be attached to the sides walls and the top.

Another application will be in the use of the anti-ballistic fabric on the inside or outside of a variety of styles of room dividers and furniture. One method will use the attachment of the anti-ballistic, fabric to a pipe frame door or room divider with the inverted "T" construction method or Speed-Rail Fittings® or other appropriate fittings at the corners and pipe intersections of the unit. Fabric clamps, as one possible method, are used to secure the fabric surface completely around the individual pipe segments. Additionally, a progressive expandable sleeve with calculated impact load stretch, breakaway stitching and progressively stronger stitching, is another possible way to construct the Anti-Ballistic Shelters herein. An additional application would be to use a pillow case type of attachment of the anti-ballistic fabric slipping it over a framework with breakaway stitching holding it in place.

Still another possible application is the attachment of the anti-ballistic fabric, to a pipe frame cot by using the inverted "T" construction method or fabric clamps to secure the anti-ballistic fabric surface completely around the pipe segments with Speed-Rail Fittings® at the corners and intersections. This application could be used on a conventional wood or aluminum or other material cot and still remain within the scope of this application, but it would not have the structural strength of the steel pipe frame construction.

A further application will be the installation, of the anti-ballistic, fabric to the inside of a conventional door with a calculated shock load impact absorbing crushable foam member on each side of the anti-ballistic fabric of the door. The outer decorative layer of such equipped doors can be varied from penetrable fabric to penetrable thin plastic or other similar materials. Soft armor can be placed on the surface of the inside of the door, this is the protected side (victim side) as opposite of the outside (or perpetrator/shooter side) of the door because it requires an area of flexibility or expansion to work effectively when struck by a projectile, to allow for a backside protrusion. If these materials are completely restricted their effectiveness is diminished. The antiballistic fabric is held in place by the means of adhesives, threaded fasteners, or other means.

The anti-ballistic fabric can additionally be used within or as a covering for a pad, a furniture cushion or a mattress with or without handles where it can be held, up in a defensive position.

The unique use of anti-ballistic fabric is also anticipated as a covering for an umbrella with the conventional shepherds hook or other common use handles or an additional second hand support grip with a variety of end members including a defensive spike on the top. A spring loaded, or calculated hydraulic compression member, such as those available from STABILIS®, may be included in the handle to absorb the shock of being struck by a projectile. The umbrella has bendable rib members in the manner of a conventional umbrella, and may have a sliding opening mechanism that is held in the open position by the means of a spring loaded latching mechanism. The sliding opening mechanism will have extension arms extending out to each of the rib members supporting the umbrella in the open position. The size and design of the umbrella may have fewer or greater bendable rib members compared to the conventional umbrella with flexible ribs to accommodate the heavier weight of the antiballistic fabric. The number of frame members or ribs and sizes used will depend upon the degree of bullet resistance required.

With respect to the above description then, it is to be realized that the optimum dimensional relationships of the methods of manufacturing Anti-ballistic Shelters, to include variations in size, materials, shape, form, function and manner of operation assembly and use, are deemed readily apparent and obvious to one skilled in the art, and all equivalent relationships to those illustrated in the drawings and described in the specification are intended to be encompassed by the present methods of manufacturing Anti-ballistic Shelters. Therefore, the foregoing is considered as illustrative only of the principles of this application. Further, since numerous modifications and changes will readily occur to those skilled in the art, it is not desired to limit the methods of manufacturing Anti-ballistic Shelters to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the Anti-ballistic Shelters and together with the description, serve to explain the principles of this application.

FIG. 1A depicts a perspective illustration of a Quonset but style of Anti-ballistic Shelter.

FIG. 1B depicts a pipe or tubular supporting member.

FIG. 1C depicts a solid supporting member.

FIG. 1D depicts an extruded "T" supporting, member.

FIG. 1E depicts an "I" beam supporting member,

FIG. 1F depicts a "U" channel supporting member.

FIG. 1G depicts an open sided tubular, or "C" shaped, supporting member.

FIG. 21 depicts a perspective view of a single rib member end and the end covering cap.

FIG. 22 depicts an end view of a single rib member.

FIG. 23 depicts a cross section of a single rib member when struck by a projectile as that projectile enters through a frame member and adjacent to a frame member.

FIG. 24A depicts a cross section of a single rib member with the "T" construction method and calculated stretch material before being struck by a projectile.

FIG. 24B depicts a cross section of a single rib member with the "T" construction method and calculated stretch material just after being struck by a projectile, showing the stretch material stretching downward and away from the frame member.

FIG. 25 depicts an umbrella with a shepherds hook handle incorporating shock absorption spring activated member.

FIG. 26 depicts an umbrella with straight handle grip with a shock absorption spring activated member.

FIG. 27 depicts an umbrella handle with a hydraulic shock absorption member.

FIG. 28 depicts an umbrella handle with a ball end.

Figure 3:
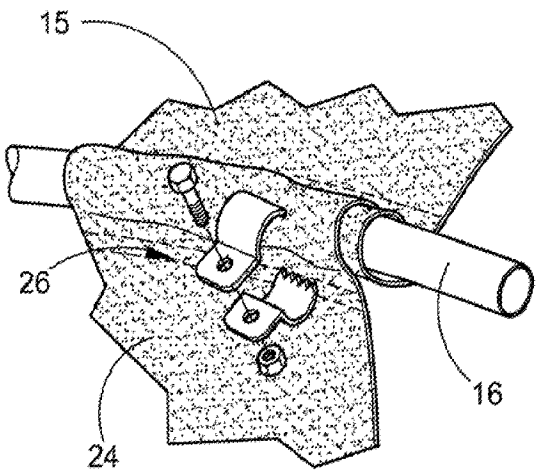
FIG. 3 depicts a perspective illustration of the method of attachment of the anti-ballistic fabric surface to the curved support structure by using wrapping and clamps.

For a fuller understanding of the nature and advantages of the Anti-ballistic Shelters, reference should be had to the following detailed description taken in conjunction with the accompanying drawings which are incorporated in and form a part of this specification, illustrate embodiments of the design and together with the description serve to explain the principles of this application.

DETAILED DESCRIPTION OF EXAMPLE EMBODIMENTS

As required, detailed embodiments of the present methods of manufacturing Anti-ballistic Shelters are disclosed herein, however, it is to be understood that the disclosed embodiments are merely exemplary of the methods of manufacturing Anti-ballistic Shelters that may be embodied in various forms. Therefore, specific functional and structural details disclosed herein are not to be interpreted as limiting, but merely as basis for the claims and as a representative basis for teaching one skilled in the art to variously employ the present design in virtually any appropriately detailed structure.

Referring now to the drawings, wherein similar parts of the methods of manufacturing Anti-ballistic Shelters 10 is depicted in FIG. 1A as a steel pipe frame Quonset Hut style of Anti-ballistic Shelter 12 with horizontal pipe members 14A with an anti-ballistic fabric 15 covering the hoop style pipe supporting members 16. Bullet resistant material such as Lexan® or equivalent will be used for the windows 68 shown on one of the front panels.

Additional door support pipe members 18 and the ground level pipe members will be held together by the means of Speed-Rail Fittings® 20 made by Hollaender™ Manufacturing Inc. for aluminum fittings or Kee Klamp™ pipe fittings for steel fittings. The upper anti-ballistic fabric 15 surface, the front wall anti-ballistic fabric 24 and rear wall not show will be covered with layers of flexible anti-ballistic fabric (soft armor) layered in two directions. Varying numbers of horizontal pipe members 14A and hoop style pipe supporting members 16 may vary depending upon where larger numbers are required for adequate protection from possible larger projectiles. The supporting members may include a variety of different styles including the pipe or tubular style depicted as 14A in FIG. 1B, a solid, supporting member 14B in FIG. 10, a extruded "T" supporting member 140 in FIG. 1D, a "I" beam supporting member 14D in FIG. 1E, a "U" channel supporting member 14E in FIG. 1F, and an open sided, or "C" shaped tubular supporting member 14F in FIG. 1G. A variety of shapes of pipe frame structures including tents, lean-tos and canopies can be constructed in this manner and will remain within the scope of this application.

Figure 2A:
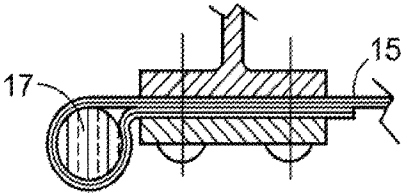
FIG. 2A depicts a cross section of the anti-ballistic fabric in a clamped configuration with a rope or solid flexible retainer.

FIG. 2A depicts a cross section of the anti-ballistic fabric 15 in a clamped configuration with a rope or solid flexible retainer 17 member.

Figure 2B:
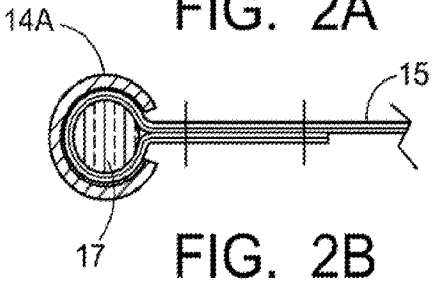
FIG. 2B depicts a cross section of the anti-ballistic fabric enclosed within the open sided tubular supporting member with a rope or solid flexible retainer.

FIG. 2B depicts a cross section of the anti-ballistic fabric 15 enclosed within the open sided tubular supporting member 14F with a rope or solid flexible retainer 17 member.

Figure 2C:
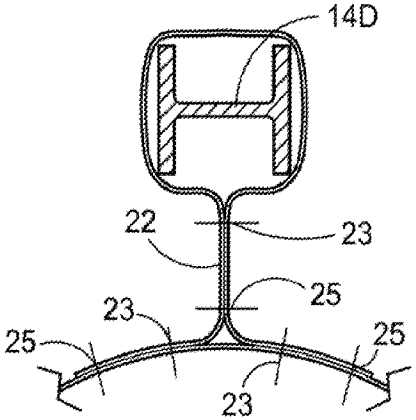
FIG. 2C depicts a cross section of the anti-ballistic fabric sewn in an inverted "T" around an extruded "I" Shaped supporting member showing the locations of breakaway stitching and securing or holding stitching.

FIG. 2C depicts a cross section of the anti-ballistic fabric sewn in the inverted "T" construction method, around an extruded "I" shaped supporting member 14D showing the locations of breakaway stitching 23 and securing or holding stitching 25. The material extending downward from the extruded "I" shaped supporting member 14D is a calculated stretch material 22 which may be comprised of anti-ballistic material or it may be comprised of material that is not anti-ballistic in nature. This calculated stretch material 22 is designed to stretch upon projectile impact in a load bearing calculated fashion and also may or may not include a breakaway stitching 23 and or a holding stitching 25 (as is shown here in FIG. 2C). Alternative to the stitching method of construction of the inverted "T" state of the art adhesives may be used to create the same effect of breakaway strength and holding strength to allow the anti-ballistic material to give but at the same time prevent penetration and pass though of a projectile.

Figure 2D:
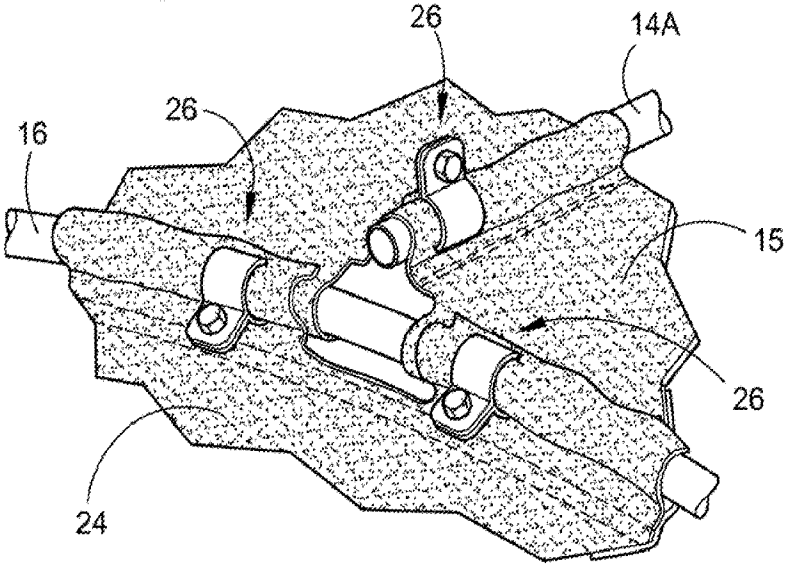
FIG. 2D depicts a perspective illustration of the attachment of the anti-ballistic fabric surface by using clamps to the supporting frame structure.

FIG. 2D depicts a perspective illustration of the attachment of the upper anti-ballistic fabric 15 surface to the horizontal pipe members 14A and front wall anti-ballistic fabric 24 to the hoop style pipe supporting members 16 with fabric clamps 26. Having potential forces exerted on the material by a projectile the fabric clamps must be very rugged and closely spaced. Again state of the art adhesives may be used in the construction here in place of the sewn stitching.

Figure 4:
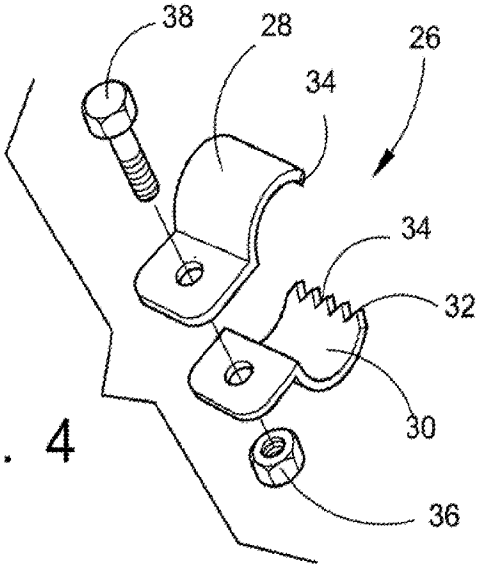
FIG. 4 depicts an exploded perspective view of the anti-ballistic fabric surface clamping means shown in FIG. 3.

FIG. 3 depicts a perspective illustration of the method of attachment of the anti-ballistic material to the curved support structure by rolling the material around the pipe members and using multiple fabric clamps 26. Here again the potential forces exerted on the material by a projectile the fabric clamps must be very rugged and closely spaced, FIG. 4 depicts an exploded perspective view of the anti-ballistic material fabric 15 clamp 26 illustrating the upper clamp member 28 and lower clamp member 30 having a plurality of teeth 32 on the gripping edges 34. A nut 36 and bolt 38 will secure the two halves tightly together.

Figure 5:
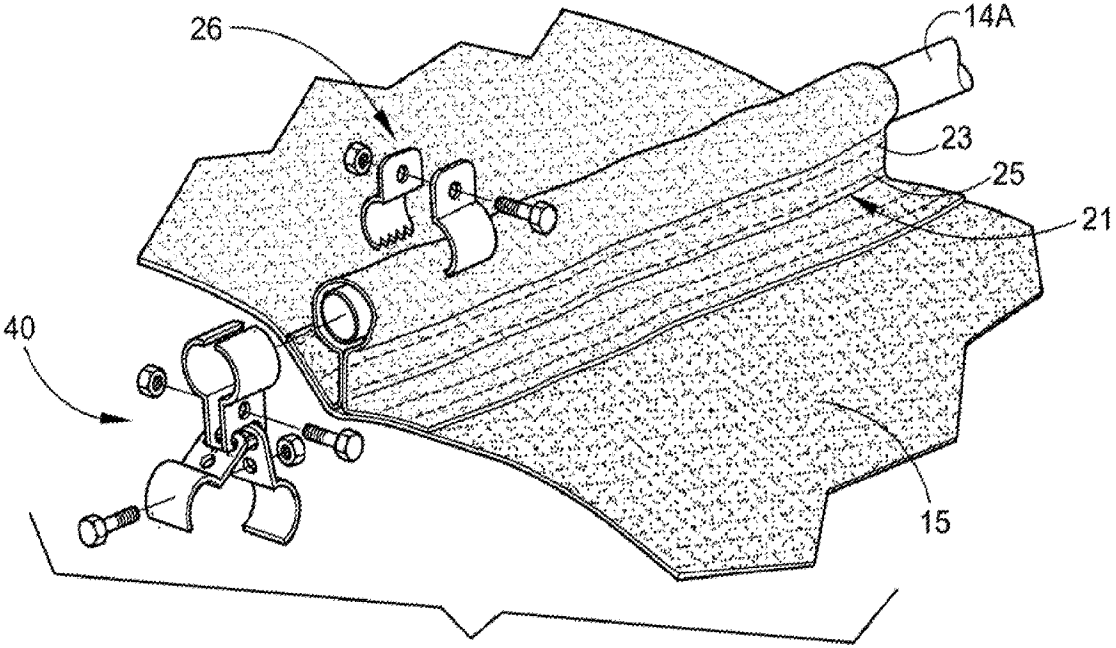
FIG. 5 depicts a perspective illustration of the attachment of the anti-ballistic fabric surface to the horizontal support structure and the unique bi-directional pipe clamp.

FIG. 5 depicts a perspective illustration of the attachment of the anti-ballistic upper fabric 15 surface to the horizontal support structure 14A and the unique bi-directional pipe clamp 40. The bi-directional pipe clamp 40 has been designed to raise the horizontal pipe members 14A away from the hoop style pipe supporting members 16 (as shown in FIG. 1) and to give enough space for the fabric clamps 26 to secure the upper anti-ballistic fabric 15 surface completely around the horizontal pipe members 14A with the added benefit of the inverted "T" construction method 21 with a breakaway stitch 23 and a holding stitch 25. Likewise, state of the art adhesives may be used in the construction here in place of the sewn stitching. This inverted "T" construction of the anti-ballistic material can be incorporated in all types of shelters including tents (see below), cots, framed room dividers, umbrellas, boat and vehicle covers.

Figure 6:
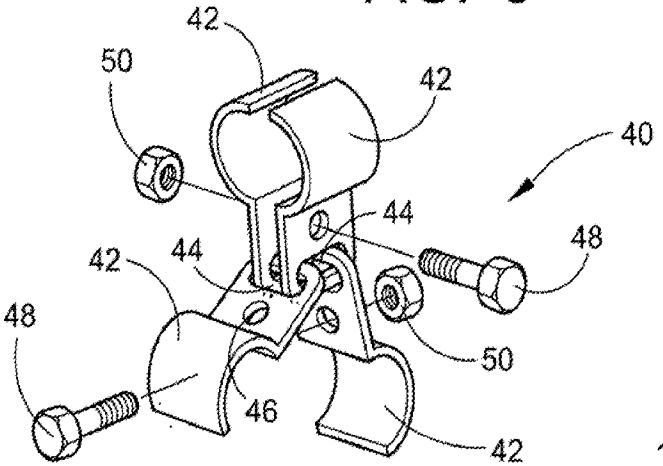
FIG. 6 depicts an exploded perspective illustration of the bi-directional pipe clamp used to attach the horizontal member to the curved support structure.

FIG. 6 depicts an exploded perspective illustration of the bi-directional pipe clamp 40 used to attach the horizontal member 14A to the curved hoop style pipe supporting members 16. The bi-directional pipe clamp 40 consists of four common clamping segments 42 with elongated holes 44 where the two pairs of the clamping segments 42 will interlock. Orifices 46 will be used by the bolts 48 and nuts 50 to clamp the bi-directional pipe clamp 40 to the horizontal pipe member 14A and the hoop style pipe supporting members 16 (as shown in FIG. 1A). The benefit in using these fittings is that they are made of steel not aluminum and much less subject to breakage under high impacts.

Figure 7A:
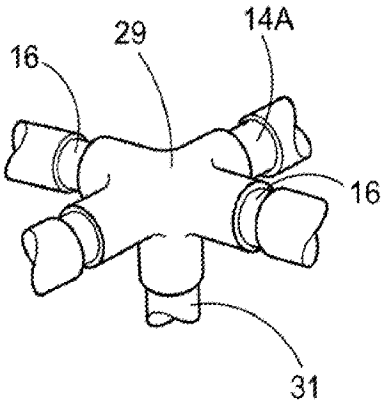
FIG. 7A depicts a perspective illustration of a five way tubular connector to be used when a center pole is required.

FIG. 7A depicts a perspective illustration of a five way tubular connector 29 to be used when a center pole 31 is required. Two-way, three-way, and four-way connectors are also anticipated, as well as various shaped connectors depending upon the type of frame member used, pipe, tubular, solid, extruded shapes (see FIGS. 14A through 14G), etc., which may be incorporated into the construction of the anti-ballistic shelters.

Figure 7B:
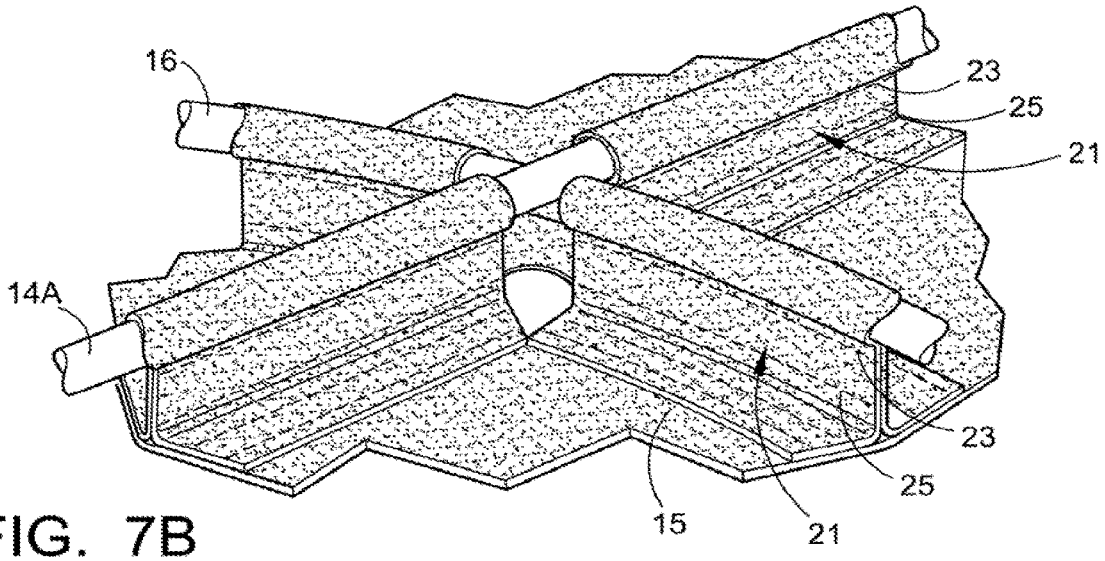
FIG. 7B depicts a perspective illustration of the attachment of the anti-ballistic fabric surface using the fabric inverted "T" construction method.

FIG. 7B depicts a perspective illustration of the attachment of the upper anti-ballistic fabric 15 surface using the fabric inverted "T" construction method 21 with fabric stitches 23 and 25 over the horizontal pipe member 14A and the hoop style pipe supporting members 16. The inverted "T" construction method 21 has been designed where the anti-ballistic fabric 15 surface is loosely covering the supporting pipe members 14A and 16 with two or more stitches 23 and 25 running the length of the section. This creates a progressive expandable sleeve. The stitches 23 and 25 on either side of the supporting pipe members 14A and 16 will absorb the initial shock and most likely one or more of these stitches will break away while one or more of the stitches will receive less shock and will resist being completely broken away, depending upon the direction and angle of the projectile. In this way, the layers of fabric stop a projectile from penetration, by the stitches breaking away until they hold. The number of layers and the quantity of stitches will depend upon the degree of bullet resistance required. The cross-section juncture of the frame in FIG. 7A could include the extrusion fitting shown in FIG. 7B if necessary.

Figure 8A:
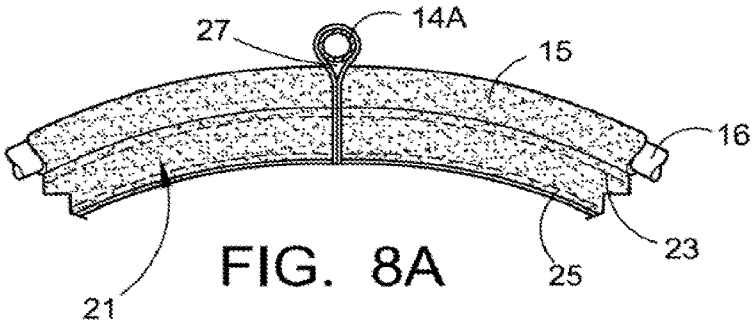
FIG. 8A depicts an end view of the cross-over of the horizontal pipe frame and the hoop style pipe member with the anti-ballistic fabric surface covering.

FIG. 8A depicts an end view of the cross-over of the horizontal pipe member 14A and the hoop style pipe supporting member 16 illustrating the gap 27 with loose upper anti-ballistic fabric 15 surface covering the horizontal pipe member 14A.

Figure 8B:
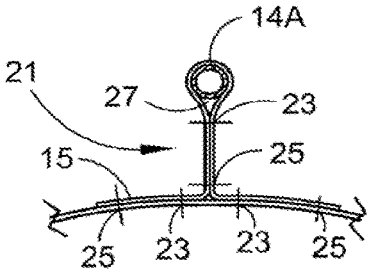
FIG. 8B depicts an end view of the inverted "T" construction method with a breakaway stitch and a holding stitch in the anti-ballistic fabric surface.

FIG. 8B depicts an end view of the inverted "T" construction method 21 with a stitches 23 and 25 shown, and the gap 27 in the loose upper anti-ballistic fabric 15 surface clearly depicted. It must be understood that the inverted "T" construction method 21 is not limited to two lines of stitches but may have two or more lines of stitches and still remain within the scope of this application. The number of stitches and distance apart create a progressive expandable sleeve. The number of layers and the quantity of stitches will depend upon the degree of bullet resistance required. It is also anticipated that a calculated stretch material may be used extending downward from the frame member to the body of the shelter. This calculated stretch material portion may he made from anti-ballistic fabric or fabric that does not have anti-ballistic characteristics, but in either case is designed to stretch to enhance the anti-ballistic nature of the shelter so constructed.

Figure 9:
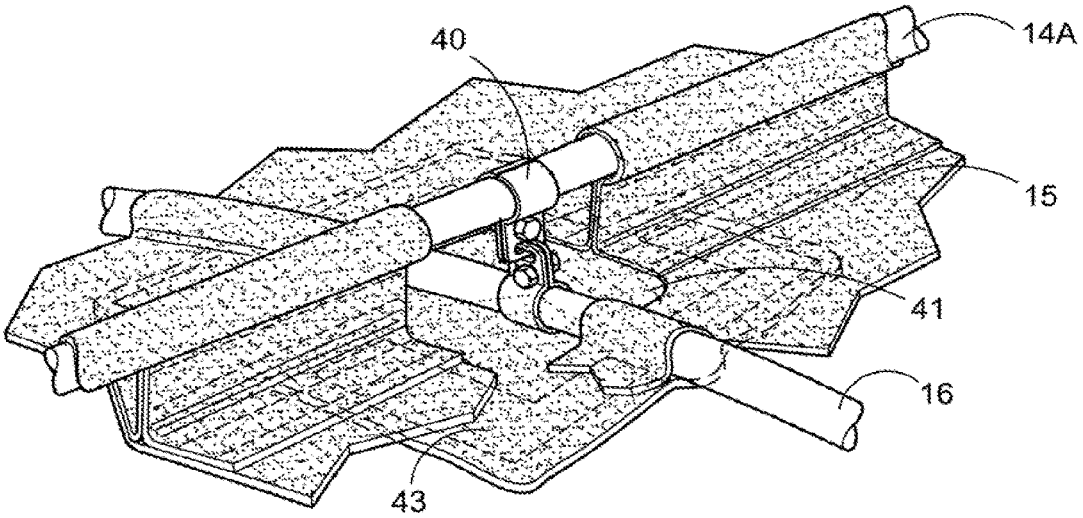
FIG. 9 depicts a perspective view of the cross-over of the horizontal pipe frame and the hoop style pipe member with the anti-ballistic fabric surface covering using the bidirectional pipe clamp and a soft or hard armor patch.

FIG. 9 depicts a perspective view of the cross-over of the horizontal pipe frame 14A with the hoop style pipe member 16 having the upper anti-ballistic fabric 15 surface and the bi-directional pipe clamp 40. The space below the intersection of the horizontal pipe frame 14A with the hoop style pipe member 16 creates an opening 41 in the upper anti-ballistic fabric 15 surface that will be closed with a patch 43 made from soft armor or hard armor material.

Figure 10:
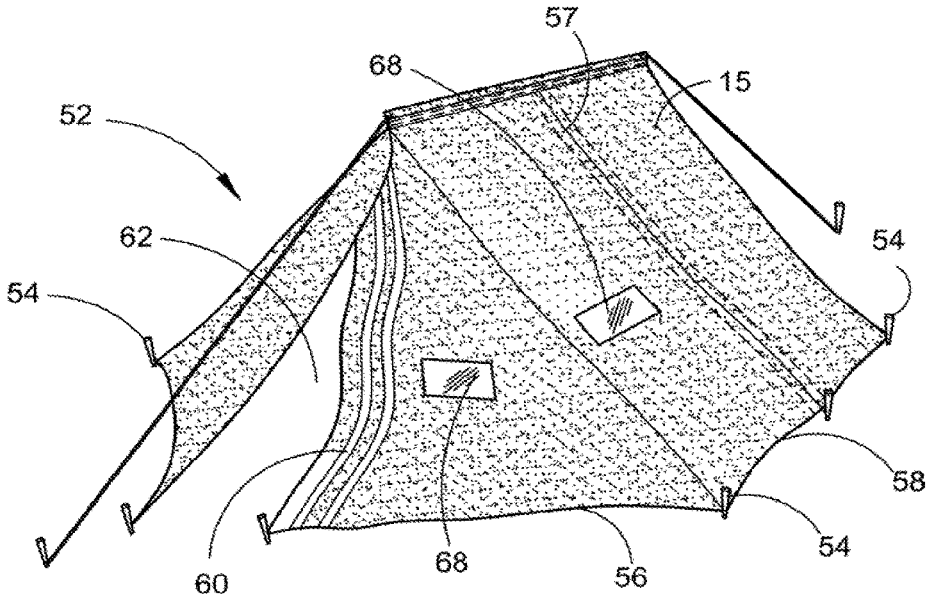
FIG. 10 depicts a perspective view of a conventional pup tent incorporating the anti-ballistic fabric surface with a hook loop attachment means for the fly door and a window incorporated in one of the side panels and one of the front door panels.

FIG. 10 depicts a perspective view of a conventional pup tent 52 incorporating the anti-ballistic fabric 15 surface. The perimeter of the pup tent 52 will have a plurality of tent stakes 54 and a cable 56 along the tent lower edge 58. There can be a hook and loop attachment means 60 for the fly door 62 and a window 68 incorporated in one of the side or front panels. This window 68 may be made from bullet resistant materials (see below). Other attachment means for holding the door flaps 74 closed could be a hook and eye method. For added strength and improved anti-ballistic characteristics, a flex cable 57 may be positioned from the tent center pole down to the stake where the tent lower edge 58 meets the ground. This flex cable 58 can be sewn into the anti-ballistic material in the envelope method having breakaway stitches and holding, stitches. Alternatively, the flex cable 58 can be secured within the shelter material by the inverted "T" construction method described above, and shown used here for the tent center pole.

Figure 11:
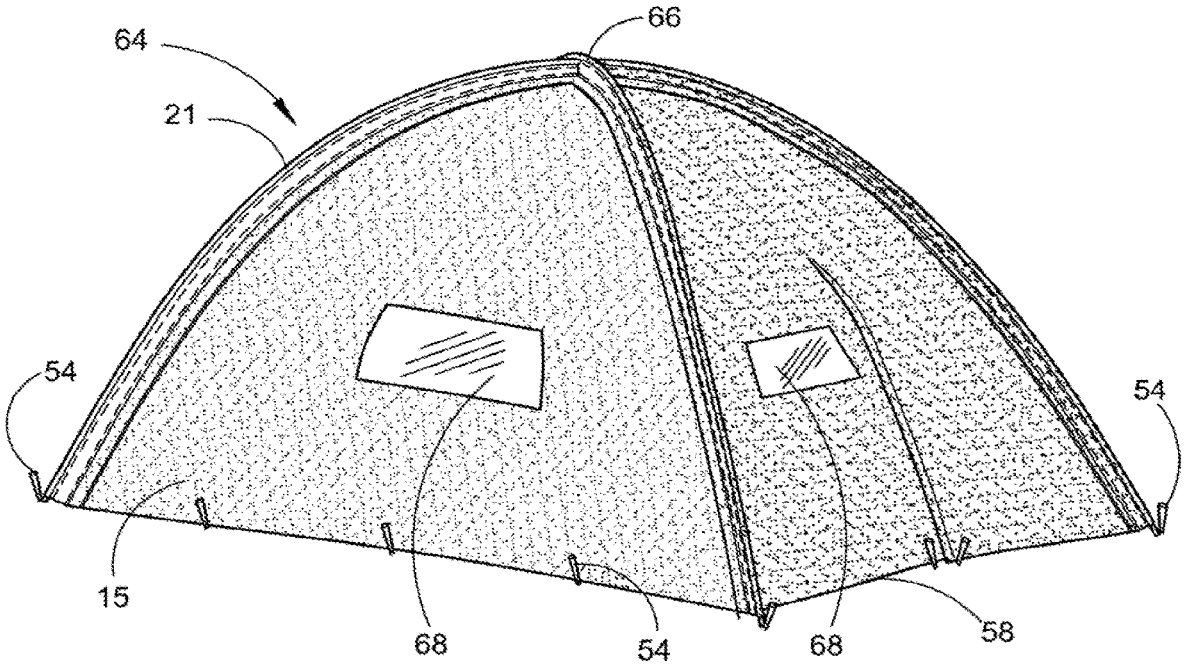
FIG. 11 depicts a perspective view of a conventional dome tent incorporating the anti-ballistic fabric surface and a window in one of the side panels and one of the front door panels.

FIG. 11 depicts a perspective view of a conventional dome tent 64 incorporating the anti-ballistic fabric 15 surface using the inverted "T" construction method 21 over the supporting flex poles 66. A plurality of tent stakes 54 and a cable 56 and will support tent lower edge 58. This illustration shows the basic dome tent 64 with two flex poles 66 (not seen) but it must be understood that two, four, six, eight, etc. or more of these poles may be used depending upon the size and degree of anti-ballistic protection required and will still remain within the scope of this application. The dome tent may also feature windows 68 in any one of the side panels, rear panels or front panels as desired. The windows 68 are constructed of bullet resistant or bulletproof glass (also known as ballistic, glass, transparent armor or bullet-resistant glass) is a type of strong but optically transparent material that is particularly resistant to being penetrated when struck. Like any material, however, they are not completely impenetrable.

Bullet resistant glass is usually made from a combination of two or more types of glass, one hard and one soft. The softer layer makes the glass more elastic, so it can flex instead of shatter. The index of refraction for both of the glasses used in the bulletproof layers must be almost the same to keep the glass transparent and allow a clear, undistorted view through the glass. Bulletproof glass varies in thickness from three-quarter inch to three inches (19 mm to 76 mm). Bullet-resistant or bulletproof glass is typically usually constructed using polycarbonate, thermoplastic, and layers of laminated glass. The aim is to make a material with the appearance and clarity of standard glass but with effective protection from small arms. Polycarbonate designs usually consist of products such as Armormax®, Makroclear®, Cyrolon®, Lexan® or Tuffak®, which are often sandwiched between layers of regular glass.

Figure 12B:
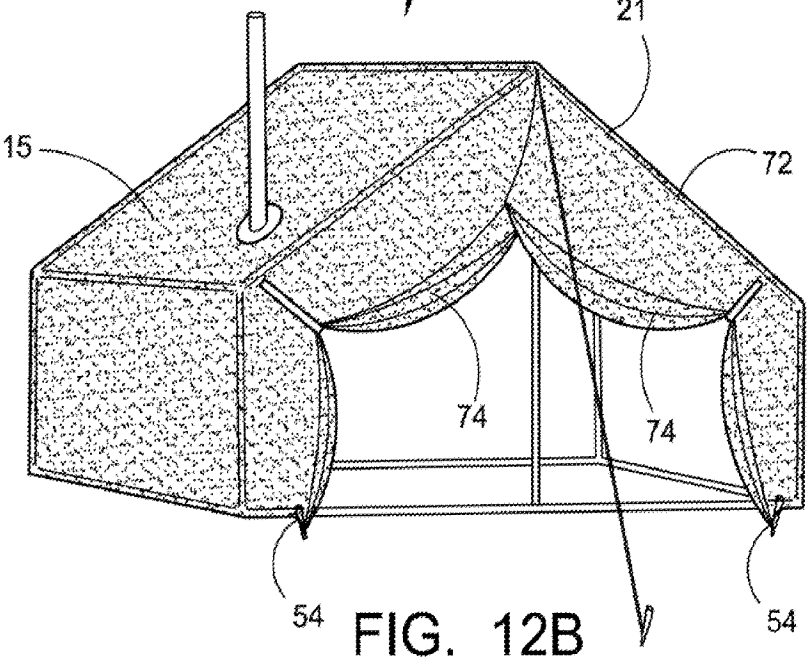
FIG. 12B depicts a perspective view of a wall tent with the door flaps open.
Figure 12A:
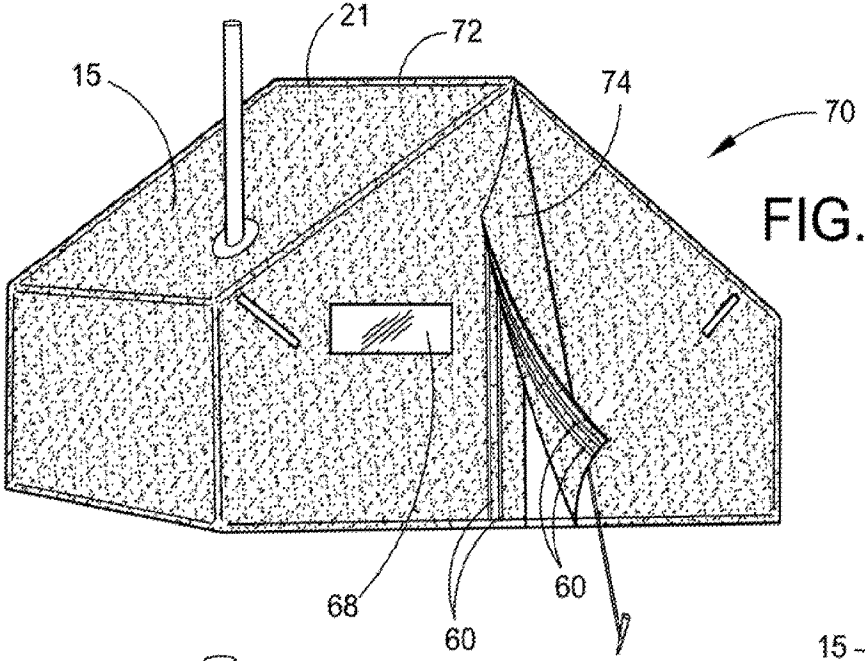
FIG. 12A depicts a perspective view of a wall tent with the door flaps closed by the means of a hook loop fastening means and a window incorporated in one of the front panels.

FIG. 12A depicts a perspective view of a wall tent 70 with anti-ballistic fabric 15 surface using the inverted "T" construction method 21 on all four sides and top with a steel pipe frame work 72 and a bullet resistant window 68 incorporated in one of the front or side panels. The wall tent in this view has the overlapping door flaps 74 partially closed. The doors may be secured using a double line 60 of hook and loop material such as wide Velcro®. It is anticipated that more sections may be added to the wall tent depending upon the need for space and they can be extended longitudinally with other frame and anti-ballistic fabric 15 constructed sections.

FIG. 12B depicts a perspective view of a wall tent 70 with the door flaps 74 held open by tent stakes 54. The wall tent in this view has the overlapping door flaps 74 opened. It is anticipated that more sections may be added to the wall tent depending upon the need for space and they can be extended longitudinally with other frame and anti-ballistic fabric 15 constructed sections. There are three optional attachment means for attaching the anti-ballistic material to the frame members: (1) by the wrapping and clamping method described above; (2) by the inverted "T" and stitching, method, using a breakaway stitch and a holding stitch, also described above; and (3) by the envelope method, described above and below, also using a breakaway stitch and a holding stitch.

Figure 13B:
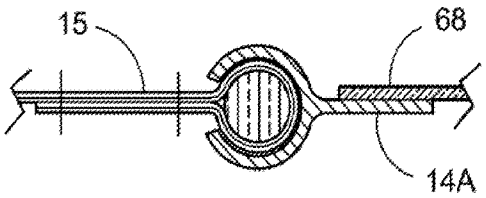
FIG. 13B depicts a cross section of the attachment means of connecting the window to the anti-ballistic fabric using an open sided tubular supporting member.
Figure 13A:
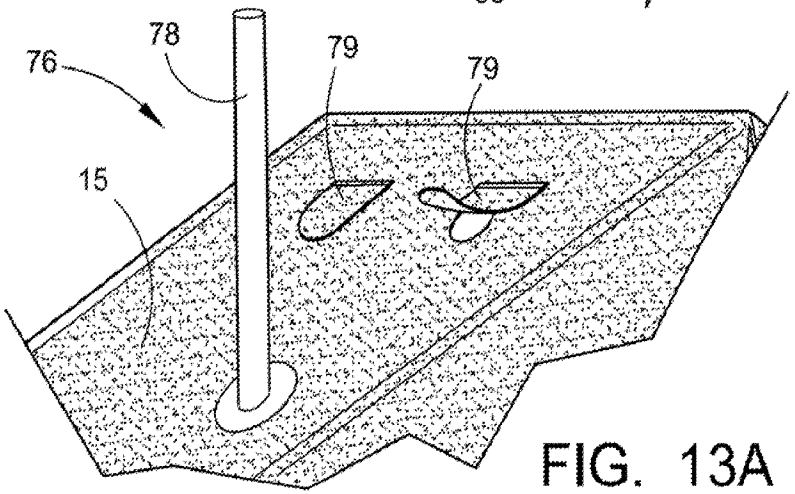
FIG. 13A depicts a perspective view of a roof panel with a stove pipe and two roof vents, one open and one closed.

FIG. 13A depicts a perspective view of a roof panel 76 with anti-ballistic fabric 15 surface having a stove pipe 78 and two roof vents 79, one open and one closed. Other conventional roof vents can be adapted for this purpose.

FIG. 13B depicts a cross section of the attachment means of connecting the bullet resistant window 68 to the anti-ballistic fabric 15 using an open sided tubular supporting member 14F and state of the art adhesives may also be used to attach the window 68 material.

Figure 14:
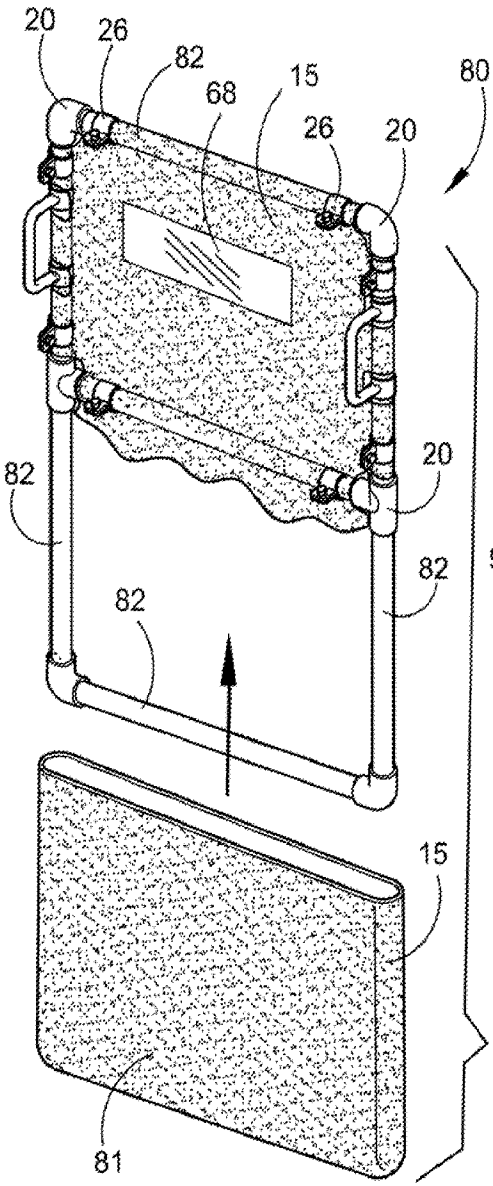
FIG. 14 depicts a perspective illustration of the attachment of the anti-ballistic fabric surface with a window to a pipe frame door or room divider as well as the use of an anti-ballistic material slip cover.

FIG. 14 depicts a perspective illustration of the attachment of the anti-ballistic fabric 15 to a pipe frame door or room divider 80 having a window 68 with Speed-Rail Fittings® 20 used at the corners and pipe intersections of the unit. Fabric clamps 26 are used to secure the anti-ballistic fabric 15 completely around the individual pipe segments 82. The inverted "T" construction method 21 will work equally well in this application. An alternate embodiment of the room divider 80 will have a removable slip cover 81 that will slide over a variety of different frame works. The removable slip cover may also be stitched on to the frame in the same manner as the material is attached to the cot shown in FIG. 15 below.

Figure 15:
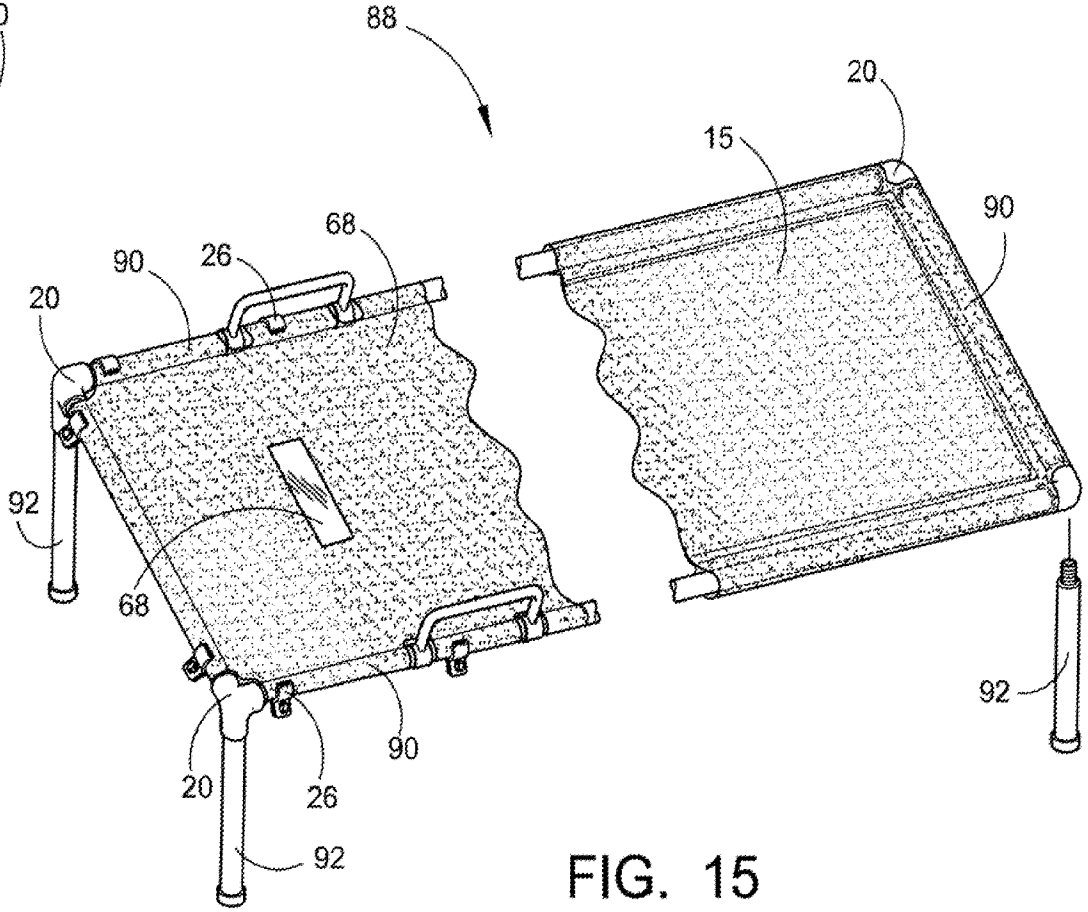
FIG. 15 depicts a perspective illustration of the attachment of the anti-ballistic fabric surface with a window to a pipe frame cot.

FIG. 15 depicts a perspective illustration of the attachment of the anti-ballistic fabric 15 surface to a pipe frame cot 88 with a window 68 by using the fabric clamps 26 to secure the anti-ballistic fabric 15 surface completely around the pipe segments 90 with Speed-Rail Fittings® 20 at the corners and intersections where the legs 92 to the cot thread into. The inverted "T" construction method again will work equally well in this application. This application could be used on a conventional wood or aluminum cot and still remain within the scope of this application, but it would not have the structural strength of the steel pipe frame construction. The cot sleeping surface 68 would act as a bullet resistant or bulletproof shield, when easily and quickly picked up and held up, or transported as needed.

Figure 16:
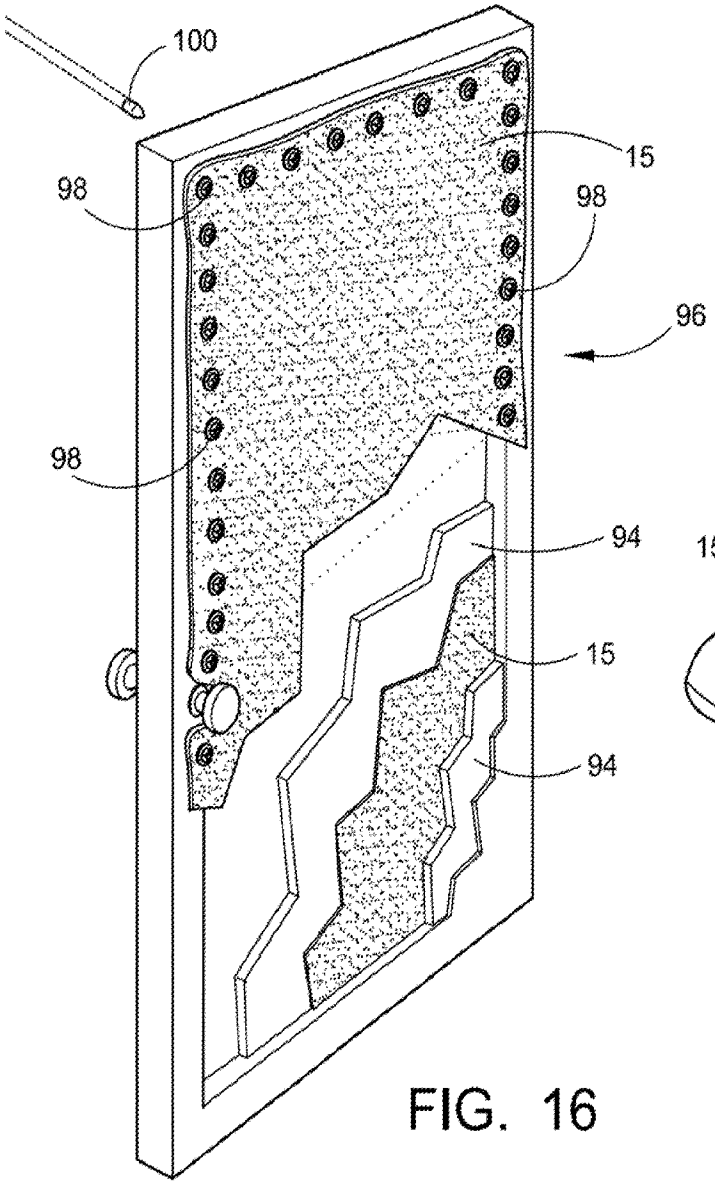
FIG. 16 depicts a perspective illustration of the attachment of the anti-ballistic fabric surface to the inside surface, or the protected side, of an existing door or room divider with a cutaway showing the installation of the anti-ballistic fabric on the interior portion of an existing conventional door with a cushioning from member on each side of the anti-ballistic fabric within the door.

FIG. 16 depicts a perspective illustration of the attachment of the anti-ballistic fabric 15 surface to the inside surface (the protected side) of an existing door 78 or as in the cutaway showing the installation of the anti-ballistic fabric 15 to the inside of an existing conventional door 96 with a calculated impact load absorbing crushable foam member 94 on each side of the anti-ballistic fabric 15 within the door 96. Soft armor has been placed on the inside protected surface of the door because it requires an area of flexibility or expansion to work effectively when struck by a projectile. If these materials are completely restricted their effectiveness is diminished. The anti-ballistic fabric surface 15 is held in place by the means of multiple threaded fasteners 98. Other means for fastening are also anticipated, such as the use of adhesives, edge molding, or other fastening means. A bullet 100 is shown traveling towards the front outside, the perpetrator side, of the existing door indicating the maximum means of protection offered by the anti-ballistic fabric surface 15.

Figure 17:
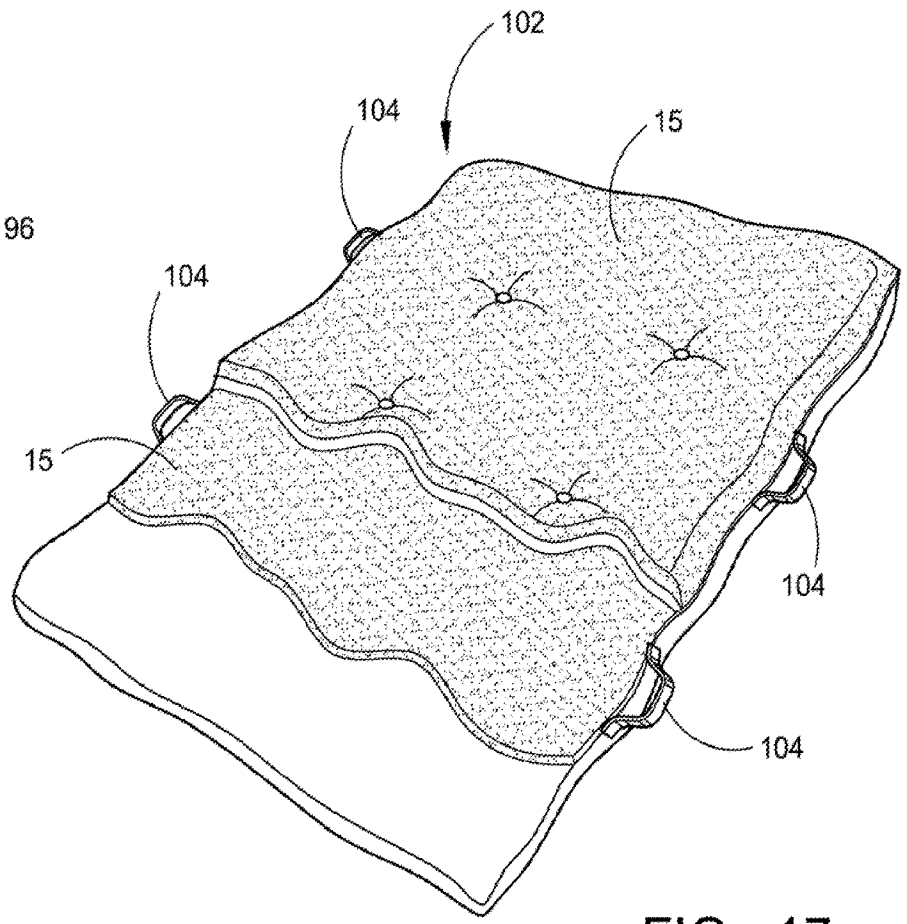
FIG. 17 depicts a perspective illustration of the anti-ballistic fabric on the surface used as a covering and alternatively on the interior portion of furniture cushions, pads or mattresses.

FIG. 17 depicts a perspective illustration of the anti-ballistic fabric 15 on the surface used as a covering or on the inside of cushions of mattresses 102 with handles 104 on both sides so that the cushions or mattresses 102 can be held up in a defensive position if required. When the anti-ballistic fabric is positioned ion the interior of the mattress or cushion pad it may be sandwiched between two layers of foam for the purpose of cushioning.

Figure 18:
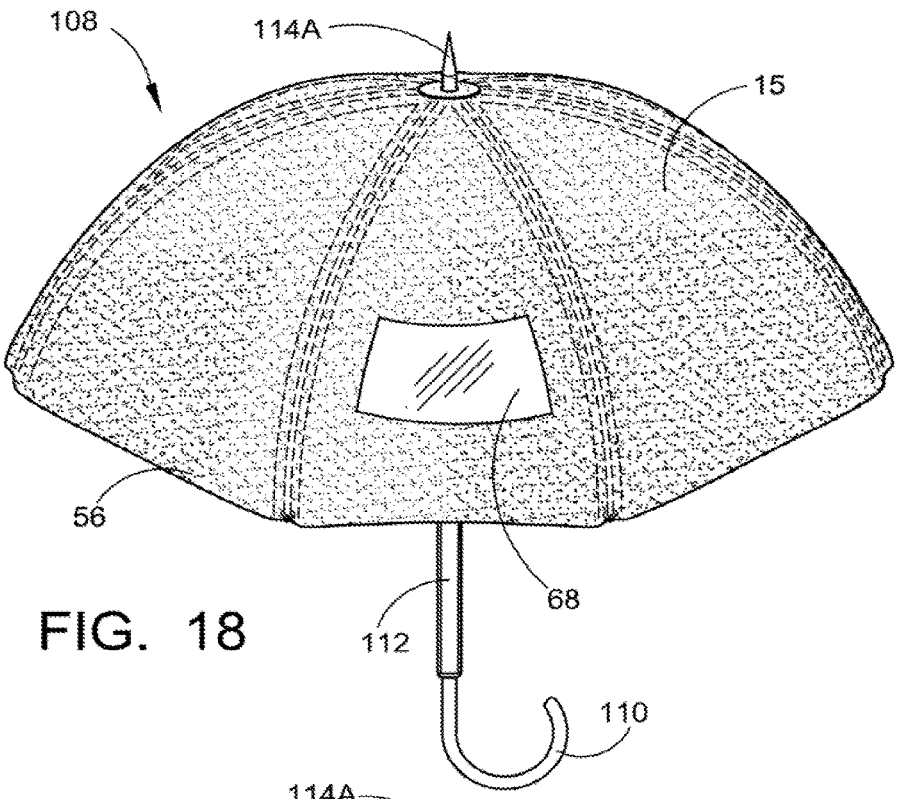
FIG. 18 depicts a perspective illustration of the anti-ballistic: fabric surface used as a covering for a unique umbrella with a window incorporated in one of the panels.

FIG. 18 depicts a perspective illustration of the anti-ballistic fabric 15 surface used as a covering for a unique umbrella 108 with a window 68 incorporated in one of the panels and a conventional shepherd's hook handle 110 having an additional second hand support grip 112 and a defensive spike 114A on the top. A cable 56 is attached around the perimeter of the lower edge of the umbrella 108. Other handle configurations and arrangements are also encompassed by this application. The anti-ballistic fabric covering on the outside of the umbrella may be secured by any of the following three optional attachment methods for attaching the anti-ballistic material to the umbrella frame members: (1) by the wrapping and clamping method described above; (2) by the inverted "T' and stitching method, using a breakaway stitch and a holding stitch, also described above, and (3) by the envelope method, described above and below, also using a breakaway stitch and a holding stitch.

Figure 19B:
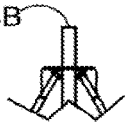
FIG. 19B depicts a side view of a blunt end umbrella tip.
Figure 19C:
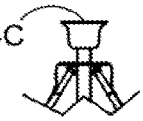
FIG. 19C depicts a side view of a rubber cushion end umbrella tip.
Figure 19D:
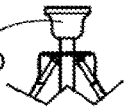
FIG. 19D depicts a side view of a suction cup end umbrella tip.
Figure 19E:
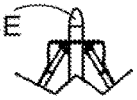
FIG. 19E depicts a side view of a round end umbrella tip.
Figure 19A:
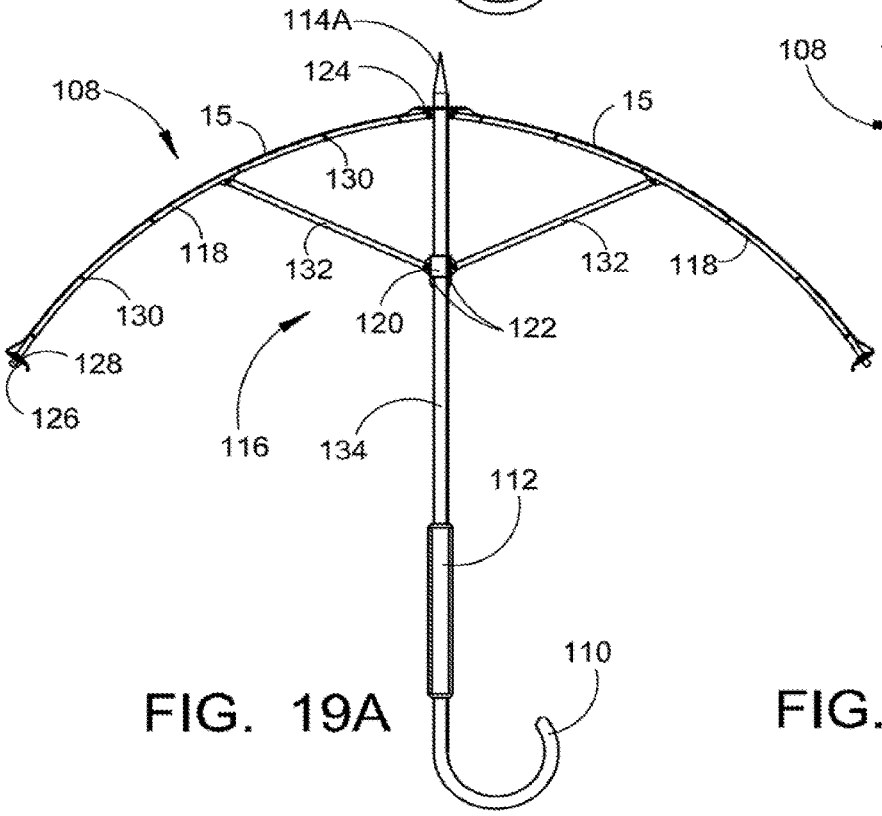
FIG. 19A depicts a side view of a section through the open umbrella frame illustrating the rigid or bendable rib members and the opening mechanism.

FIG. 19A depicts a side view of a section through the open umbrella frame 116 illustrating the rigid or bendable rib members 118 and the sliding opening mechanism 120 that are held in the open position by the means of spring loaded latching mechanism 122. The anti-ballistic fabric surface 15 may in one embodiment be held in place by a large central grommet 124 at the top that will go over the defensive spike 114A and smaller grommets 126 located at the ends of the rib members 118 that are held in place by small grommet retainers 128. The anti-ballistic fabric 15 surface will also have intermittent ties or stitching 130 to each of the rib members 118. The sliding opening mechanism 120 will have extension arms 132 extending out to each of the rib members 118 supporting the umbrella 108 in the open position. The design of the umbrella 108 with fewer rigid rib members 118 compared to the conventional umbrella with flexible ribs is to accommodate the heavier weight of the anti-ballistic fabric 15 surface. The central shaft 134 is fully exposed displaying the sliding opening mechanism 120 with the extension arms 132, spring loaded latching mechanism 122, the defensive spike 114A, the shepherds hook handle 110 and the additional second hand support grip 112. It should be understood that the anti-ballistic umbrella may be constructed with any number of rib members depending upon the degree of bullet resistance desired. In this way, the umbrella may be constructed with fewer or more rigid or bendable rib members as needed.

FIG. 19B depicts a side view of a blunt end umbrella tip 14B.

FIG. 19C depicts a side view of a cushion end umbrella tip 14C.

FIG. 19D depicts a side view of a suction cup end umbrella tip 14D.

FIG. 19E depicts a side view of a round end umbrella tip 14E. Other umbrella tip configurations and arrangements are also encompassed by this application.

Figure 20:
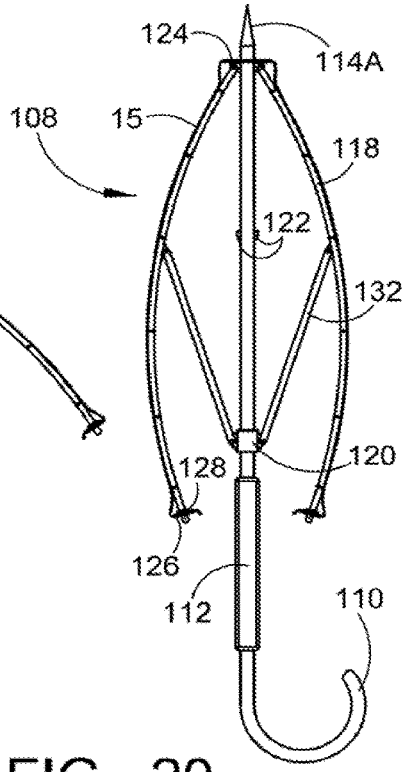
FIG. 20 depicts a side view of the closed umbrella frame illustrating the rigid or bendable rib members and the opening mechanism.

FIG. 20 depicts a side view of a section through the closed umbrella frame illustrating the rigid or bendable rib members 118 and the sliding opening mechanism 120 in the closed position. In an alternate embodiment, the previously described progressive expandable sleeve construction may be used. This construction calls for the addition of numerous stitches, including breakaway stitches and stronger holding stitches. The number of stitches and the relative strength of each stitch will depend upon the level and degree of bullet resistance desired or required by the user.

FIG. 21 depicts a perspective view of a single rib member 118 end and the end covering cap 140. This illustrates the sleeve method of attachment.

FIG. 22 depicts an end view of a single rib member 118 illustrating the loose fit of the progressive expandable sleeve type of attachment anti-ballistic fabric 15 surface and the gap (or sleeve) 27 created on either side of the rib member 118. In an alternate embodiment the previously described progressive expandable sleeve construction may be used. This construction calls for the addition of numerous stitches, including breakaway stitches 23 and stronger holding stitches 25. The number of stitches and the relative strength of each stitch will depend upon the level and degree of bullet resistance desired or required by the user.

FIG. 23 depicts a cross section of a single rib member 118 when struck by a bullet 100 where the breakaway stitch 23 has broken away and deformed the anti-ballistic fabric 15 surface while the holding stitch 25 has resisted the forces. The bullet 100 has been shown easily penetrating the anti-ballistic fabric 15 surface top layer 142 and the rib member 118 but not being able to fully penetrate the anti-ballistic fabric 15 lower layers 144 due to the flexibility and breakaway stitching 23 component of the construction.

FIG. 24A depicts a cross section of a single umbrella rib member 118 with the anti-ballistic material attached using the "T" construction method, and having calculated stretch material 22 extending downward by distance 84 from the umbrella rib member 118, before being struck by a projectile bullet 100. Also illustrated here is the positioning of the breakaway stitches 23 and the holding stitches 25.

FIG. 24B depicts a cross section of a single umbrella rib member 118 attached using the "T" construction method showing the calculated stretch material 22 stretching downward and away from the frame member just after being struck by a projectile 100. When struck by a bullet 100 the calculated stretch material 22 stretches downward a distance 86 instead of the breakaway stitches 23 being released absorbing the initial shock. In this way, the stretch material 22 absorbs the impact load and enables the breakaway stitches 23 to take more projectile force before being released. This acts to allow for a much more enhanced bullet resistant quality of the umbrella so constructed. The calculated stretch material 22 may be anti-ballistic fabric or a fabric that does not have anti-ballistic properties.

FIG. 25 depicts an umbrella 108 with a shepherds hook handle 110 incorporating shock absorption spring activated member 115 in the central shaft 134. An alternative to the absorbing spring could be a STABILIS® shock absorbing unit.

FIG. 26 depicts an umbrella with a shock absorption spring activated member 115 with the spring 148 incased within an elongated hand grip 152.

FIG. 27 depicts an umbrella handle with a STABILIS® type hydraulic shock absorption member 154 where one or more orifices 156 in a piston 158 control the directional flow by the means of a flapper valve 160 that partially closes and the hydraulic fluid 162 is metered to the opposite side of the piston 158 when there is pressure exerted on the surface of the umbrella 108. The hydraulic fluid 160 will flow back freely through the orifices 156 when the flapper valve 160 is open. A wide variety of commercial available hydraulic flow control valves will operate in a similar fashion and will be covered within the scope of this application.

FIG. 28 depicts an umbrella handle with an optional ball end 164. Other umbrella handle end configurations and arrangements are also anticipated.

Figure 29:
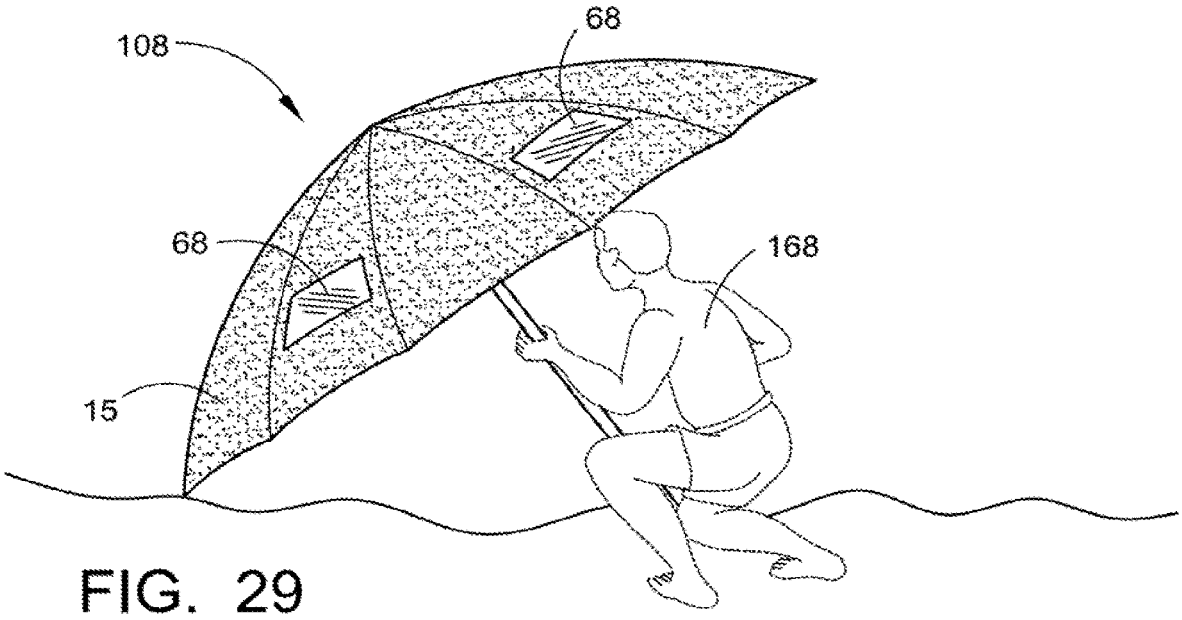
FIG. 29 depicts a large beach style umbrella with windows in two sections.

FIG. 29 depicts a large beach style of umbrella 166 with the anti-ballistic fabric 15 covering having windows 68 in two sections with a man 168 in phantom crouching behind it for protection against projectiles and bullets in the event of an active shooter at a beach, hotel pool, recreational area, etc.

Figure 30:
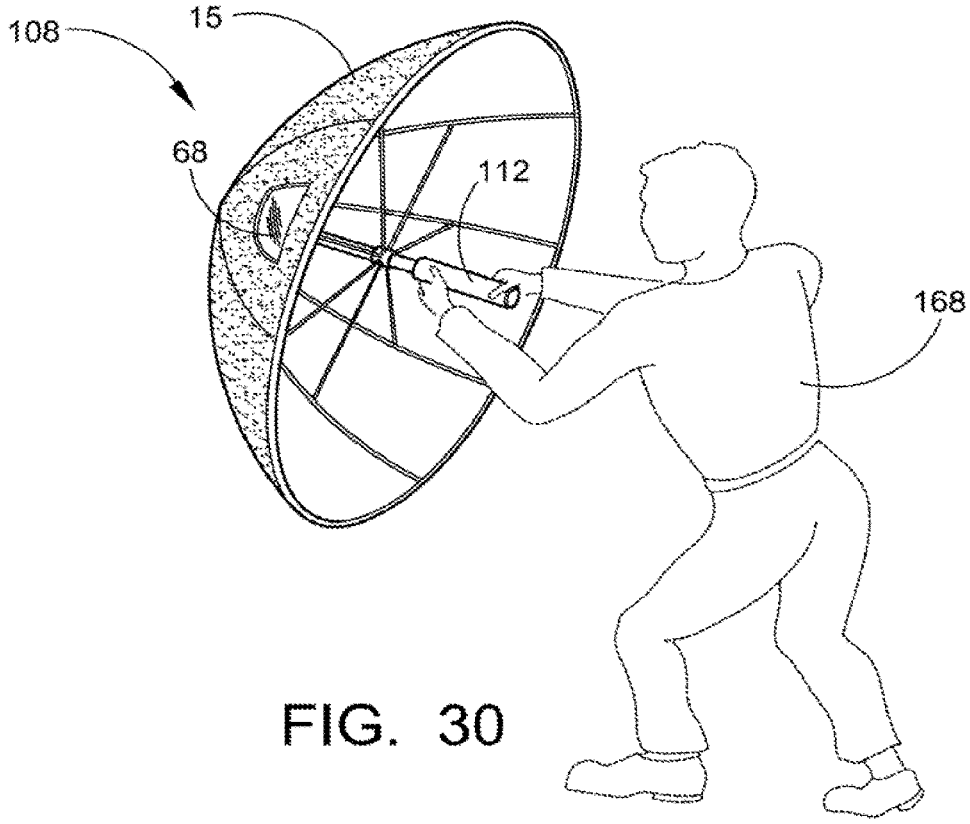
FIG. 30 depicts a man holding an umbrella in a defensive position.

FIG. 30 depicts a man 168 in phantom holding an umbrella 108 with a window 68 in a defensive position. As shown here, umbrella 108 includes a second hand support grip 112, and may also include an optional spring loaded shock absorbing feature similar to those shown in FIGS. 25-27. These defensive umbrellas may be manufactured in differing sizes, configurations, colors and decorative applications for personal use.

Figures 31A, 31B, 31C:
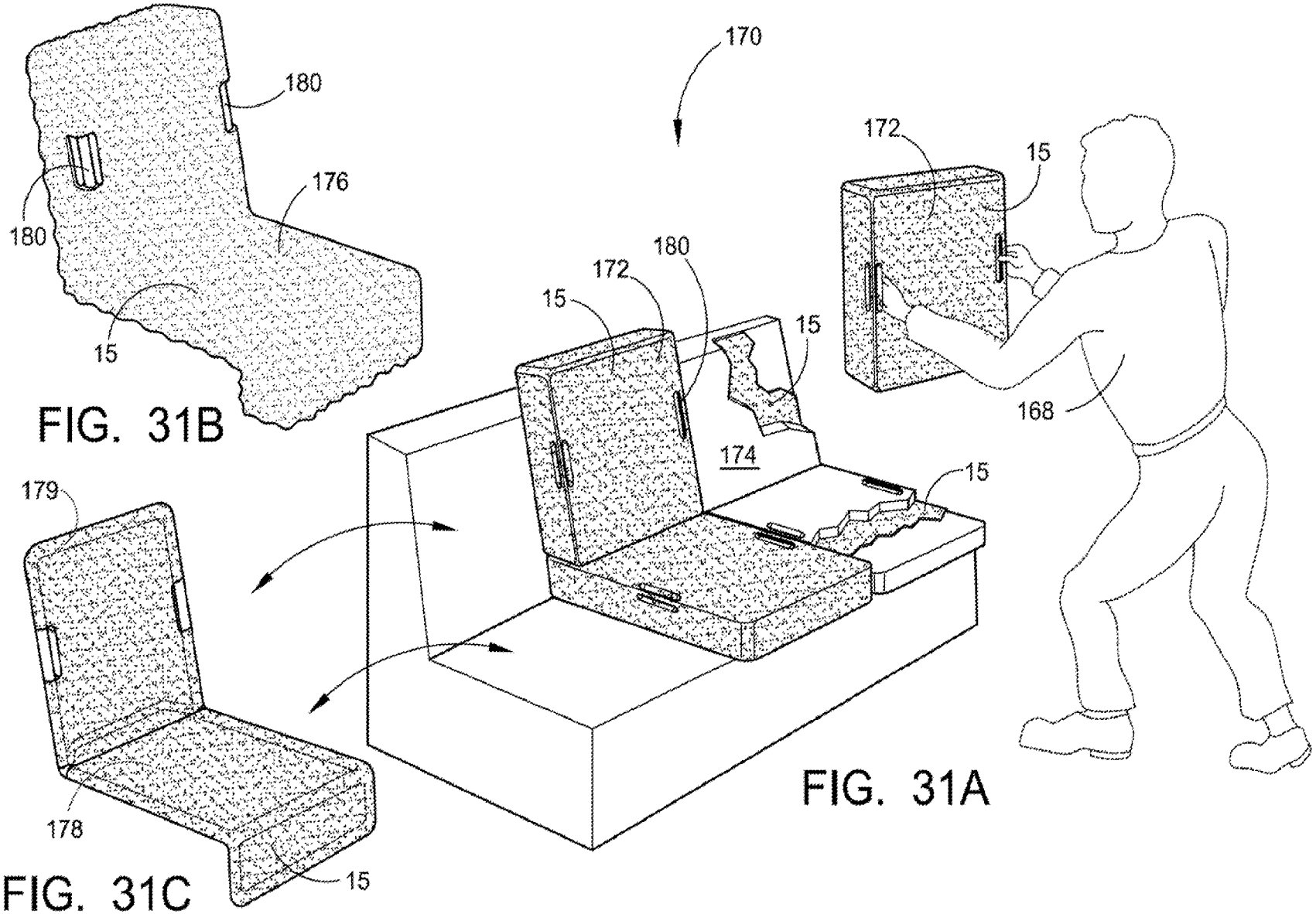
FIG. 31A depicts a piece of furniture with anti-ballistic fabric covering a cushion incorporating handles and anti-ballistic fabric interior to and incorporated into the inside portions of the furniture.
FIG. 31B depicts a slip cover constructed with an anti-ballistic fabric covering that may be placed over any conventional piece of furniture.
FIG. 31C depicts a lift-off piece of furniture using a metal frame with an anti-ballistic fabric covering, which lifted off of the furniture and held for protection.

FIGS. 31A through 31C illustrate four methods of configuring furniture and or furniture cushions with anti-ballistic material. These four methods include: (A) applying the anti-ballistic material externally on the furniture cushions; (B) applying the anti-ballistic material internally within the furniture structure; (C) providing a removable framed anti-ballistic seat member; and (D) providing an anti-ballistic cover.

In this regard, FIG. 31A depicts a piece of furniture 170 with anti-ballistic fabric 15 covering a cushion 172 incorporating optional handles 180. This is the external method of making the furniture cushions bullet resistant. Also, shown in FIG. 31A is a man 168 holding up the anti-ballistic furniture cushion 172 in a defensive position. Furthermore, FIG. 31A illustrates the internal method of creating bullet resistant furniture in that anti-ballistic fabric 15 is shown on the inside of the furniture structure 172 and illustrating anti-ballistic fabric 15 interior to and incorporated into the seating portions of the furniture 170 which may or may not be located under the cushions.

FIG. 31B depicts a slip cover 176 constructed with an anti-ballistic fabric 15 covering that may be placed over any conventional piece of furniture. The slip cover 176 may or may not have the option handles 180 as shown. It is anticipated that this type of anti-ballistic slip cover can be configured to cover any type of furniture, including sofas, chairs, recliners, patio furniture, ottomans, loveseats, sectional couches, etc.

FIG. 31C depicts a lift-off piece of furniture 178 constructed, using a metal frame 179 with an anti-ballistic fabric 15 covering, which can be lifted off of the furniture and held for protection. In FIG. 31C there is illustrated a removable framed anti-ballistic seat member 178 that has been removed after having been sitting on the furniture 170 (see FIG. 31A). The frame 179 could be constructed of a metal welded pipe frame (or a frame of other materials) with the anti-ballistic fabric 15 covering attached thereto in any of the previously disclosed methods of attachment. This framed anti-ballistic seat member 178 may be removably attached to the furniture with hook and loop material such as Velcro®, or other suitable means of attachment. Another application will have the removable framed anti-ballistic seat member 178 with anti-ballistic fabric 15 covering, incorporating handles 180 on the sides. In this way, the bullet resistant removable framed anti-ballistic seat member 178 may be readily lifted off the furniture and held for protection against projectiles.

Figures 32A, 32B, 33:
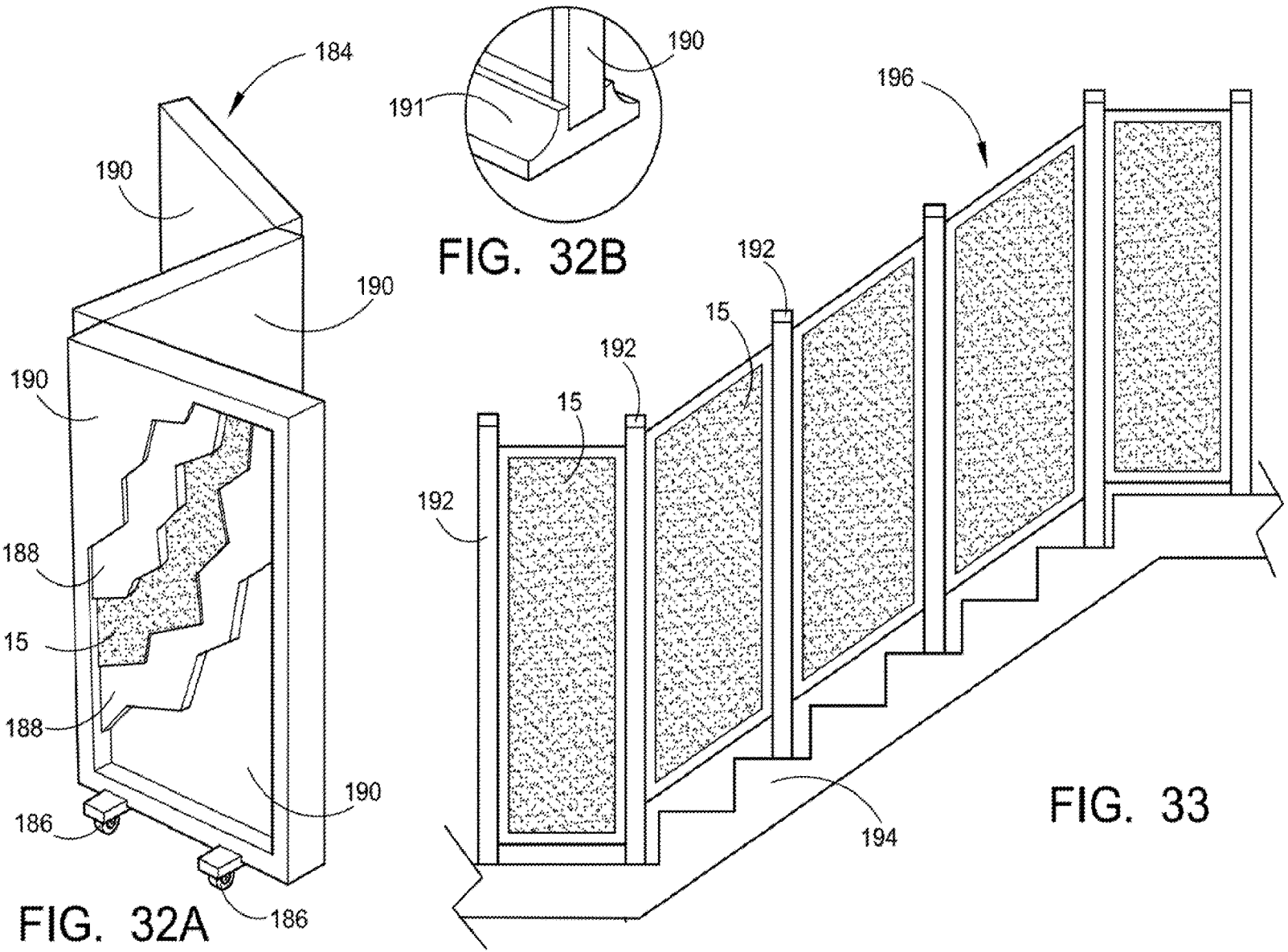
FIG. 32A depicts a bi-fold room divider panels with anti-ballistic fabric on the inside and castor wheels on the bottom for ease of unfolding and moving.
FIG. 32B depicts a partial view of the bottom of a bi-fold room divider panel with anti-ballistic fabric on the inside illustrating a slide-on foundational base installed, in place of the castor wheels.
FIG. 33 depicts a staircase with protective side panels with anti-ballistic fabric covering.

FIG. 32A depicts a room divider panels 184 on casters 186 with anti-ballistic fabric 15 on the inside between two layers of semi-solid crushable polyethylene foam 188 with calculated shock absorbing density to allow the flexibility required to keep the anti-ballistic fabric 15 functional. The outside covering of the panels can be any form of decorative covering 190 to penetrable soft material or fabric to penetrable thin plastic materials. The critical anti-ballistic, fabric could be soft armor or hard armor. The room divider panels are equally functional on a platform type base movable to other locations and plan form configurations, in place of casters. This figure shows a hinged section it also allows for door sections of similar construction.

FIG. 32B depicts a partial view of the bottom of a bi-fold room divider panel 190 with anti-ballistic fabric on the inside illustrating, a slide-on foundational base 191 installed in place of the castor wheels. The slide-on foundational base 191 may be slid in place at the bottom of the room divider panel 190 to enable a more stable, semi-permanent installation of the room divider panel. Anticipated uses include cubicle panels, trade show booth panels, theater room dividers, mall room dividers, hotel room dividers, backstage room dividers, special event room dividers, etc.

FIG. 33 depicts a staircase 194 with protective side panels 196 with anti-ballistic fabric 15 covering between supporting posts 192. These protective side panels 202 can be used for staircases 194, ramps or aisles where a side protection is required. Anticipated uses include gangways, aircraft steps, ramp ways, arbors, school stairways, and all types of ramps used for boarding and de-boarding vehicles, aircraft, vessels, spacecraft, etc.

Figure 34A:
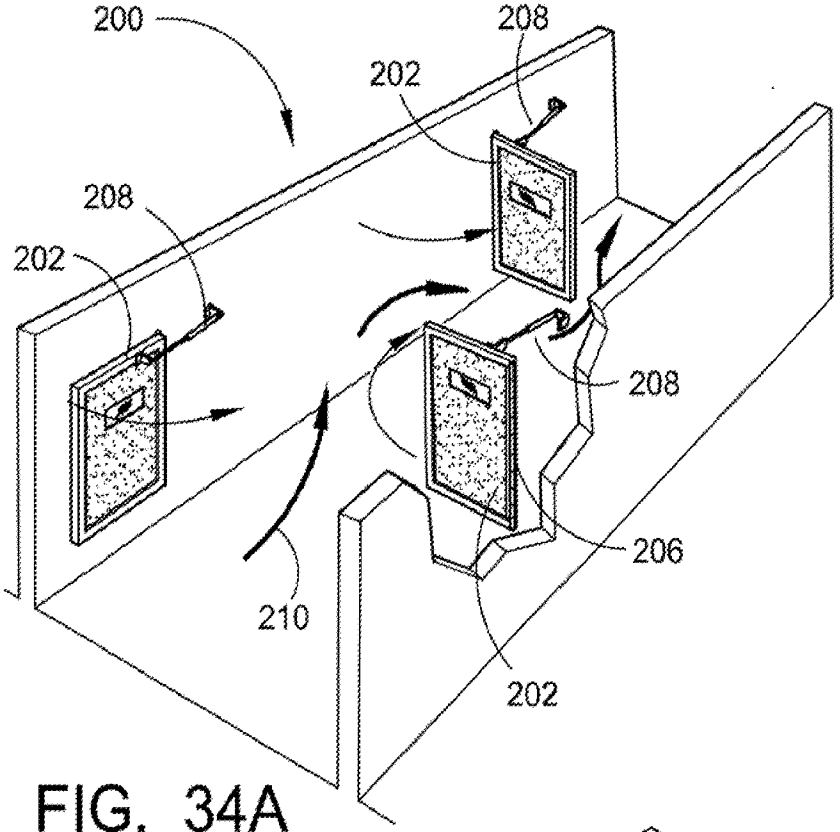
FIG. 34A depicts a corridor with panels incorporating anti-ballistic fabric that rotates out from the side by means of a remotely controlled hydraulic actuator forming a protective serpentine exit path.

FIG. 34A depicts a protective corridor 200 with panels 202 incorporating hard or soft armor anti-ballistic fabric 15 that rotate out from the side wall 204 by the means of a hinge 206 and manual or remotely controlled hydraulic actuator 208 forming a protective serpentine exit path 210. The manual or remotely controlled hydraulic actuators may be available from STABILIS®.

Figure 34B:
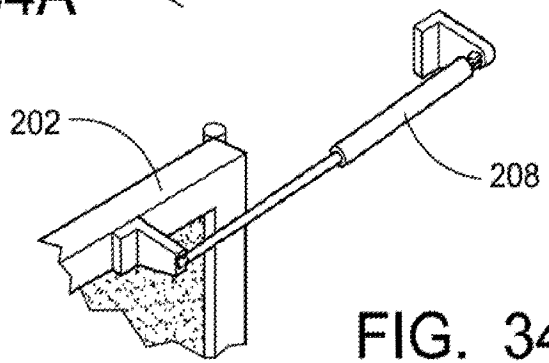
FIG. 34B depicts a perspective detail of one of the remotely controlled Stabilis® or alternative commercial actuator.

FIG. 34B depicts a perspective detail of one of the remotely controlled Stabilis® or alternative commercial hydraulic actuator 208.

Figure 35:
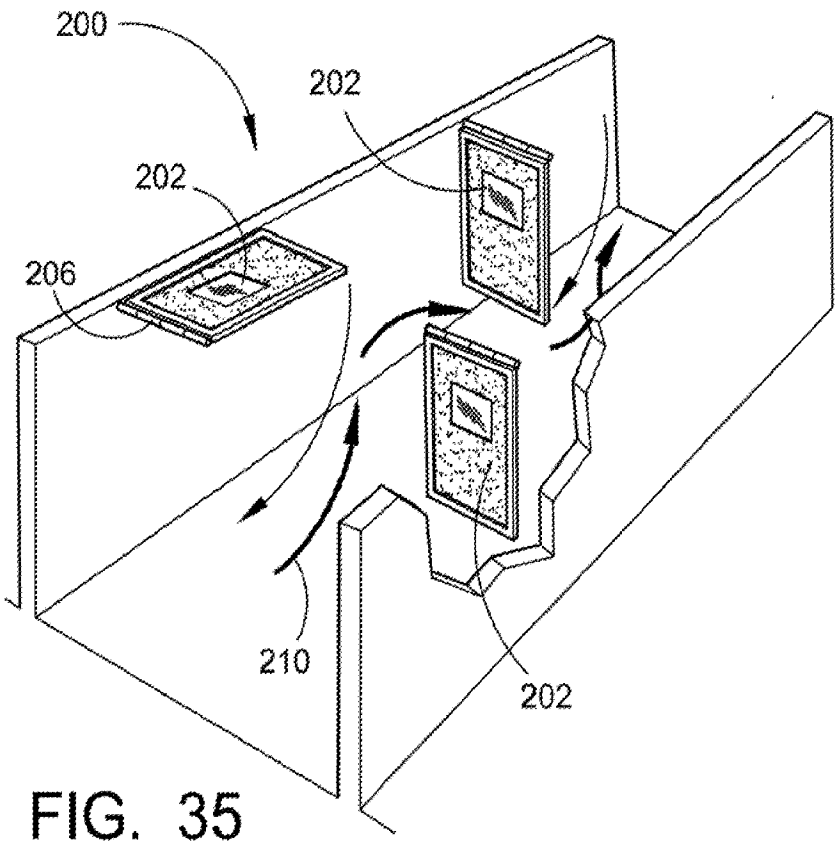
FIG. 35 depicts a corridor with panels incorporating anti-ballistic fabric that rotates down from the ceiling by means of a remotely controlled actuator forming a protective serpentine exit path.

FIG. 35 depicts a protective corridor 200 with panels 202 incorporating anti-ballistic fabric 15 that rotate down from the ceiling or alternatively out from the walls by the means of a manual or remotely controlled actuator forming a protective serpentine exit path 210. Note the use of transparent bullet-resistant or projectile resistant windows in the panels 202 of the serpentine exit path allowing some visual awareness of the location of the perpetrator, gunman or shooter in the hallway.

Figure 36:
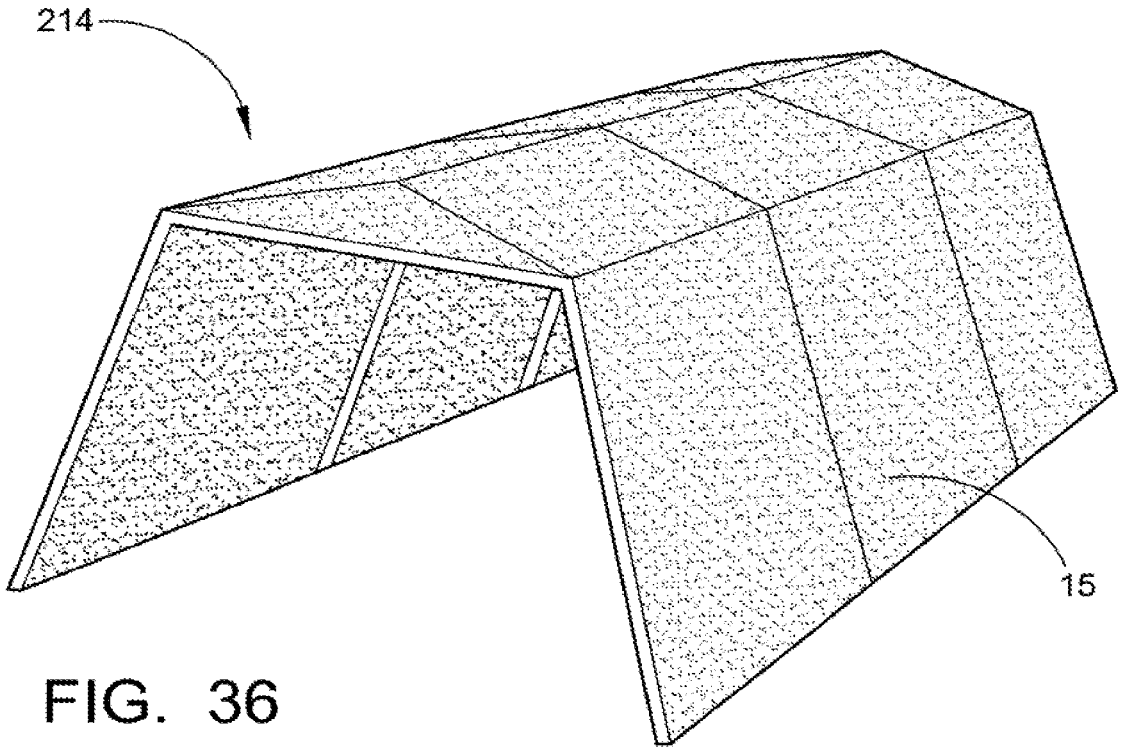
FIG. 36 depicts a carport-type shelter, boat or vehicle enclosure with anti-ballistic fabric covering.

FIG. 36 depicts a vehicle enclosure 214 with anti-ballistic fabric 15 upper surface. Anticipated uses include carports, aircraft hangers, boat covers, outdoor event covers, law enforcement, SWAT, military and firefighting command posts.

Figure 37:
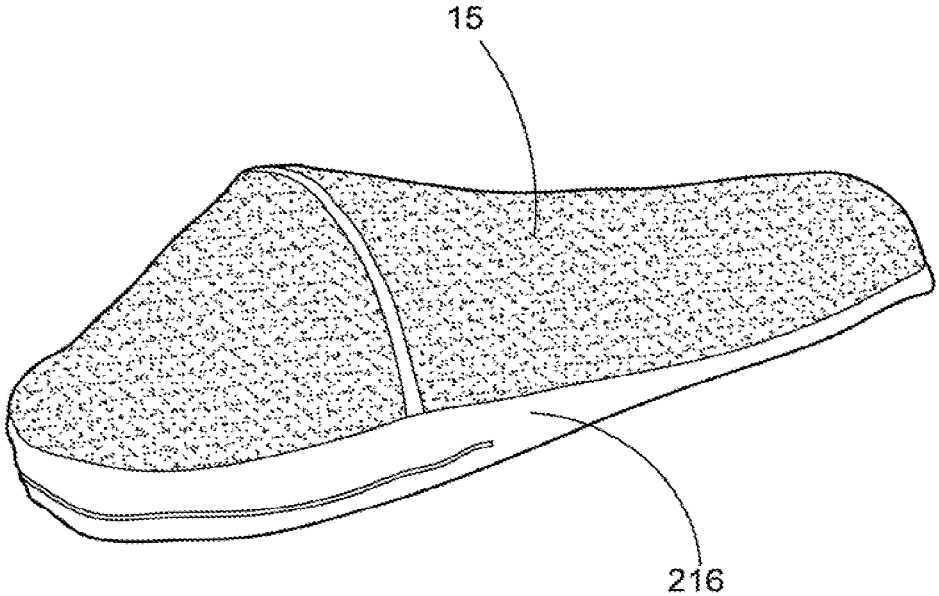
FIG. 37 depicts a one person tent, Bivy-type or sleeping bag covering with anti-ballistic fabric covering.

FIG. 37 depicts a Bivy-type one person shelter or sleeping bag covering 216 with anti-ballistic fabric 15 upper surface. This is one example of a one-person shelter that an individual may use for protection against projectiles when in exposed areas.

Figure 38:
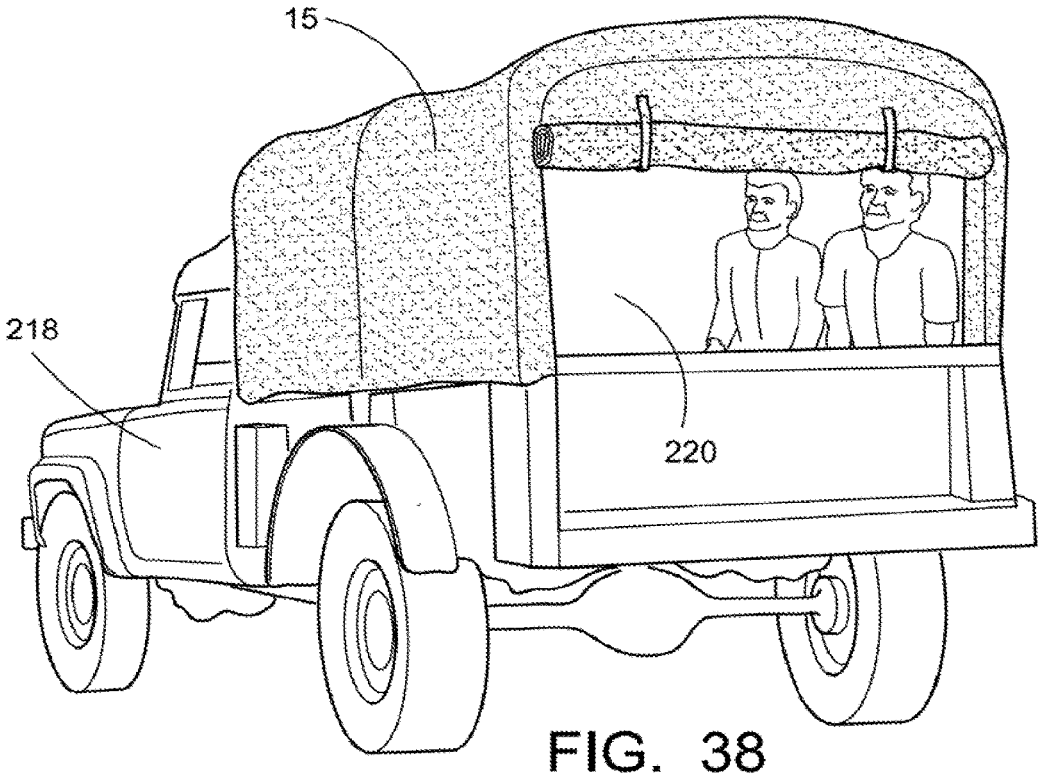
FIG. 38 depicts a truck personnel carrier with fabric covering.

FIG. 38 depicts a truck personnel carrier 218, or troop carrier with the truck personnel or troops and or the vehicle cargo area 220 covered with anti-ballistic fabric 15 on the upper surface. Anticipated uses include all types of vehicle covers for all types of uses.

Figure 39:
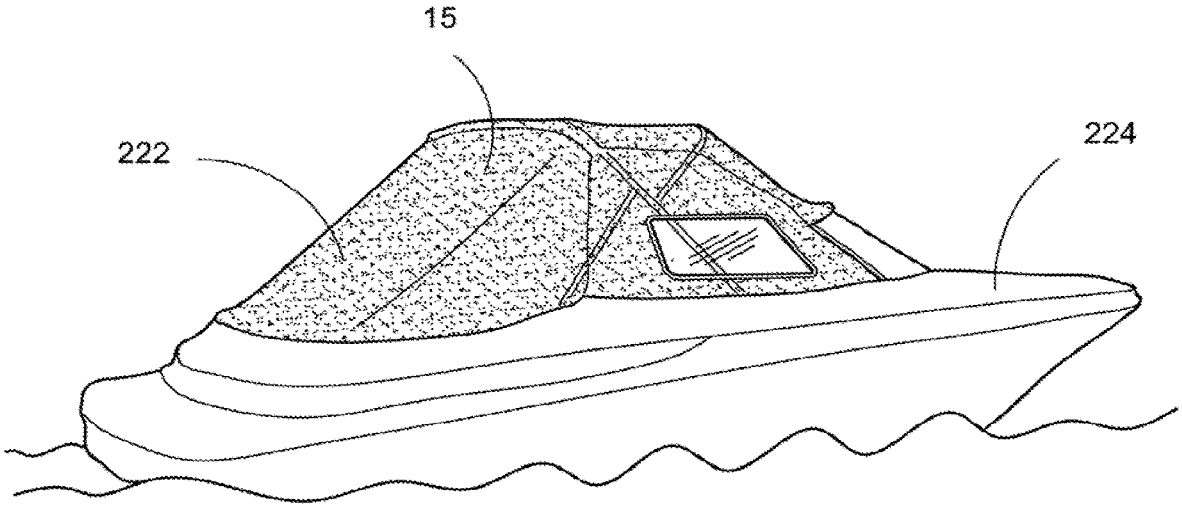
FIG. 39 depicts a Bimini-type boat cover with anti-ballistic fabric covering.

FIG. 39 depicts a Bimini-style boat covers 222 installed on a small boat 224 with anti-ballistic fabric 15 on the upper surface. Anticipated uses include all types of vessel covers for all types of uses.

The Anti-ballistic Shelters 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing an Anti-ballistic Shelters 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the disclosure of the application, which is measured by the claims, nor is it intended to be limiting as to the scope of the application in any way.

I claim:

1. An anti-ballistic shelter comprising:

a frame comprising at least one support member; and at least one wall surface comprising a high strength layered anti-ballistic material attached to said frame, wherein said high strength layered anti-ballistic material is layered in at least two directions; and further wherein said layered anti-ballistic material is attached to said frame in an inverted T construction about said frame, wherein said frame comprises a room divider, and further wherein said room divider is constructed having anti-ballistic material externally positioned or internally positioned sandwiched between crushable foam material portions.

2. The anti-ballistic shelter according to claim 1 wherein said frame comprises two at least one of: a pipe, solid rod, or extruded supporting members and correspondingly shaped connectors configured into a Quonset hut with horizontal pipe members and hoop style pipe supporting members, and further wherein said Quonset hut includes bullet resistant windows.

3. The anti-ballistic shelter according to claim 1 wherein said frame comprises a room divider, and further wherein said room divider is constructed having two or more castor wheels or a Actable foundational base.

4. A method for making an anti-ballistic shelter comprising the steps of:

providing, a frame comprising at least one support member; and providing one or more wall surfaces comprising a flexible high strength layered anti-ballistic material attached to said frame, wherein said flexible high strength layered anti-ballistic material is layered in at least two directions; and further wherein said layered anti-ballistic material is attached to said frame by sewing in an inverted T construction about said frame, wherein said frame comprises a room divider, and further wherein said room divider is constructed having anti-ballistic material externally positioned or internally positioned sandwiched between crushable foam material portions.

* * * * *